US012552509B2

(12) United States Patent
Araki et al.

(10) Patent No.: US 12,552,509 B2
(45) Date of Patent: Feb. 17, 2026

(54) JET PROPULSION BOAT THRUST CONTROL SYSTEM

(71) Applicant: KAWASAKI MOTORS, LTD., Hyogo (JP)

(72) Inventors: Toshio Araki, Akashi (JP); Kazumasa Hisada, Akashi (JP); Daisuke Kawai, Kobe (JP); Shohei Terai, Kobe (JP); Takuya Sakamoto, Akashi (JP); Yoshihito Uchino, Akashi (JP)

(73) Assignee: KAWASAKI MOTORS, LTD., Hyogo (JP)

( * ) Notice: Subject to any disclaimer, the term of this patent is extended or adjusted under 35 U.S.C. 154(b) by 442 days.

(21) Appl. No.: 18/110,892

(22) Filed: Feb. 17, 2023

(65) Prior Publication Data

US 2024/0278893 A1 Aug. 22, 2024

(51) Int. Cl.

| | |
|---|---|
| ***B63H 21/20*** | (2006.01) |
| ***B63B 34/10*** | (2020.01) |
| ***B63B 79/10*** | (2020.01) |
| ***B63H 11/08*** | (2006.01) |
| ***B63H 11/11*** | (2006.01) |
| ***B63H 21/21*** | (2006.01) |

(52) U.S. Cl.

CPC ..... *B63H 21/20* (2013.01); *B63B 34/10* (2020.02); *B63B 79/10* (2020.01); *B63H 11/08* (2013.01); *B63H 11/11* (2013.01); *B63H 21/213* (2013.01); *B63H 2021/205* (2013.01); *B63H 2021/216* (2013.01)

(58) Field of Classification Search

CPC ..... F03B 13/10; F01D 15/10; F28C 3/005

See application file for complete search history.

(56) References Cited

U.S. PATENT DOCUMENTS 2,145,493 A * 1/1939 Norquist ..... B63H 21/17 114/151
3,865,067 A * 2/1975 Archer ..... B63H 11/04 114/151

(Continued)

FOREIGN PATENT DOCUMENTS

CN 117885882 A * 4/2024 ..... B63H 25/46
FR 3055609 A1 * 3/2018 ..... B63H 21/20
WO WO-2022261294 A1 * 12/2022 ..... B63H 25/46

OTHER PUBLICATIONS

Translation CN-117885882-A (Year: 2025).*
Translation FR-3055609-A1 (Year: 2025).*
Translation WO-2022261294-A1 (Year: 2025).*

*Primary Examiner* — J. Todd Newton
(74) *Attorney, Agent, or Firm* — XSENSUS LLP

(57) ABSTRACT

A jet propulsion boat includes: a boat body; a propulsion device that imparts propulsion force to the boat body to propel the boat body; an engine and an electric motor that drive the propulsion device; and a control device that determines which of an engine mode and an electric mode is to be used as an operation mode of driving the propulsion device in accordance with a condition, the engine mode configured to drive the propulsion device with the engine and the electric mode configured to drive the propulsion device with the electric motor while stopping the engine, and controls the engine and the electric motor to drive the propulsion device in the determined operation mode.

17 Claims, 7 Drawing Sheets

(56) References Cited

U.S. PATENT DOCUMENTS

| | | | | | |
|---|---|---|---|---|---|
| 5,090,929 | A * | 2/1992 | Rieben | B63H 5/14 | 114/151 |
| 5,401,195 | A * | 3/1995 | Yocom | B63H 21/20 | 440/38 |
| 5,704,308 | A * | 1/1998 | Anderson | B63H 20/007 | 440/6 |
| 6,142,841 | A * | 11/2000 | Alexander, Jr. | B63H 25/46 | 114/151 |
| 11,866,134 | B2 * | 1/2024 | Kato | B63H 21/21 | |
| 11,932,367 | B1 * | 3/2024 | Jesewitz | B63H 21/17 | |
| 12,049,292 | B1 * | 7/2024 | Kirchhoff | G05D 13/62 | |
| 2013/0102206 | A1 * | 4/2013 | Fujino | B63H 25/04 | 440/1 |
| 2017/0253310 | A1 * | 9/2017 | Hashizume | H04B 1/385 | |
| 2023/0227135 | A1 * | 7/2023 | Shirao | G05D 1/0206 | 701/21 |
| 2023/0415878 | A1 * | 12/2023 | Durand | B63H 25/46 | |
| 2024/0278891 | A1 * | 8/2024 | Araki | B63H 11/08 | |

* cited by examiner

FIG.5

| OPERATION | MOVEMENT | LEFT LONGITUDINAL THRUSTER | RIGHT LONGITUDINAL THRUSTER | LATERAL THRUSTER |
|---|---|---|---|---|
| | FORWARD MOVEMENT | BACKWARD INJECTION | BACKWARD INJECTION | OFF |
| | BACKWARD MOVEMENT | FORWARD INJECTION | FORWARD INJECTION | OFF |
| | CLOCKWISE TURN | BACKWARD INJECTION | OFF OR BACKWARD INJECTION (SMALL) | OFF OR LEFTWARD INJECTION |
| | COUNTERCLOCKWISE TURN | OFF OR BACKWARD INJECTION (SMALL) | BACKWARD INJECTION | OFF OR RIGHTWARD INJECTION |
| | RIGHTWARD SLIDING | OFF | BACKWARD INJECTION (SMALL) | LEFTWARD INJECTION |
| | LEFTWARD SLIDING | BACKWARD INJECTION (SMALL) | OFF | RIGHTWARD INJECTION |

JET PROPULSION BOAT THRUST CONTROL SYSTEM

BACKGROUND

Technical Field

The present disclosure relates to a jet propulsion boat that moves on the water.

Background Art

Known types of a jet propulsion boat include a jet propulsion boat disclosed in US 2013/0102206 A1. To improve convenience of a jet propulsion boat, increase in a degree of freedom in operation is desirable.

SUMMARY

The present disclosure has been made in view of the above circumstances, and an object of the present disclosure is to provide a jet propulsion boat that has a high degree of freedom in operation.

To solve the above problem, a jet propulsion boat according to an aspect of the present disclosure includes a boat body, a propulsion device that imparts propulsion force to the boat body to propel the boat body, an engine and an electric motor that drive the propulsion device, and a control device that determines which of an engine mode and an electric mode is to be used as an operation mode of driving the propulsion device in accordance with a condition, the engine mode configured to drive the propulsion device with the engine and the electric mode configured to drive the propulsion device with the electric motor while stopping the engine, and controls the engine and the electric motor to drive the propulsion device in the determined operation mode.

BRIEF DESCRIPTION OF THE DRAWINGS

FIG. 5 shows a relationship between a tilting direction of the operation lever and operation (traveling direction) of the jet propulsion boat in a table format:

DETAILED DESCRIPTION

Hereinafter, a jet propulsion boat according to an embodiment of the present disclosure will be described with reference to the drawings. Although some of the drawings indicate directions of front, rear, left, and right, these directions each align with a direction viewed from a driver on the jet propulsion boat.

[Configuration of Jet Propulsion Boat]

Figure 1:
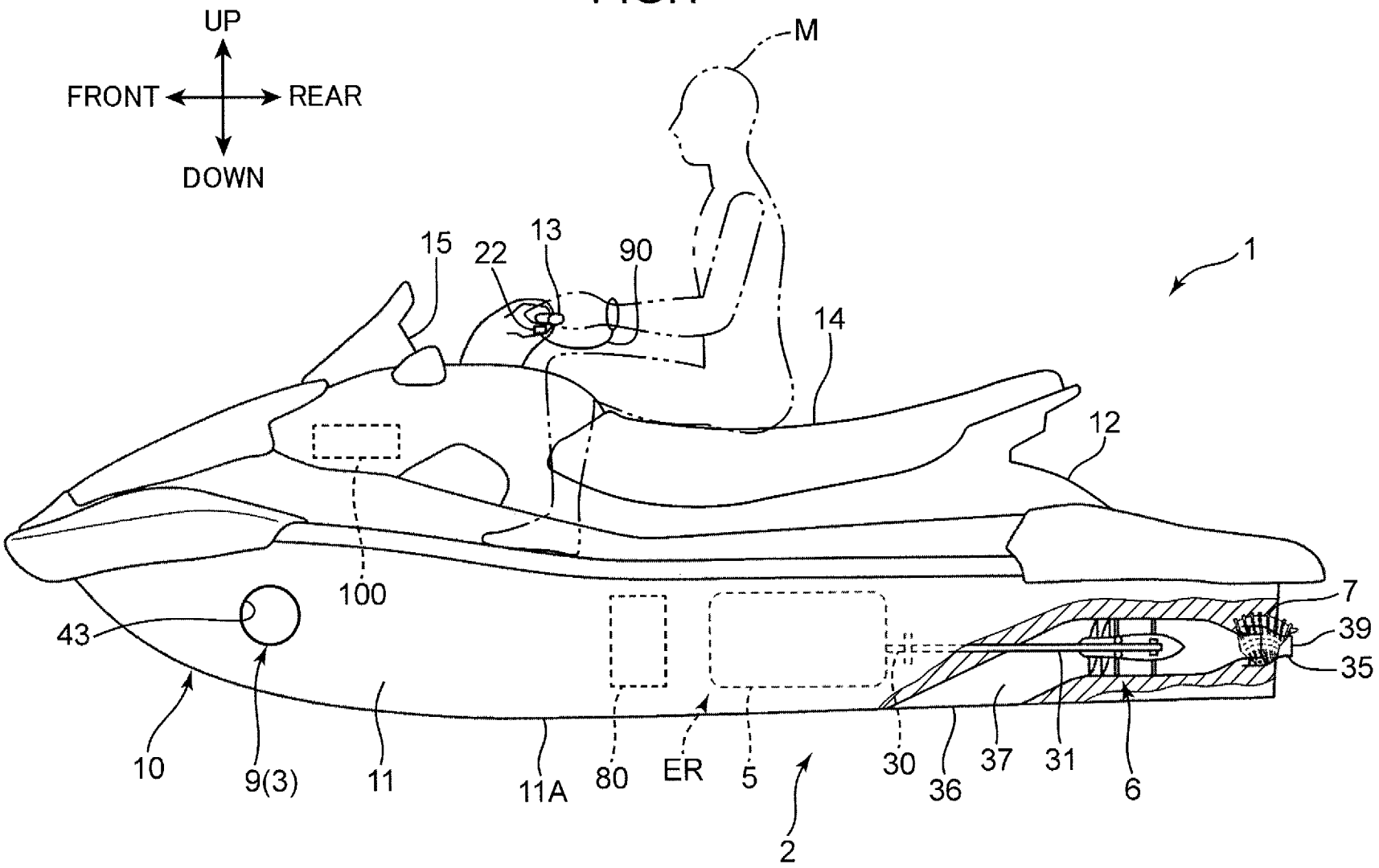
FIG. 1 is a partially broken side view of a jet propulsion boat according to a first embodiment of the present disclosure.
Figure 2:
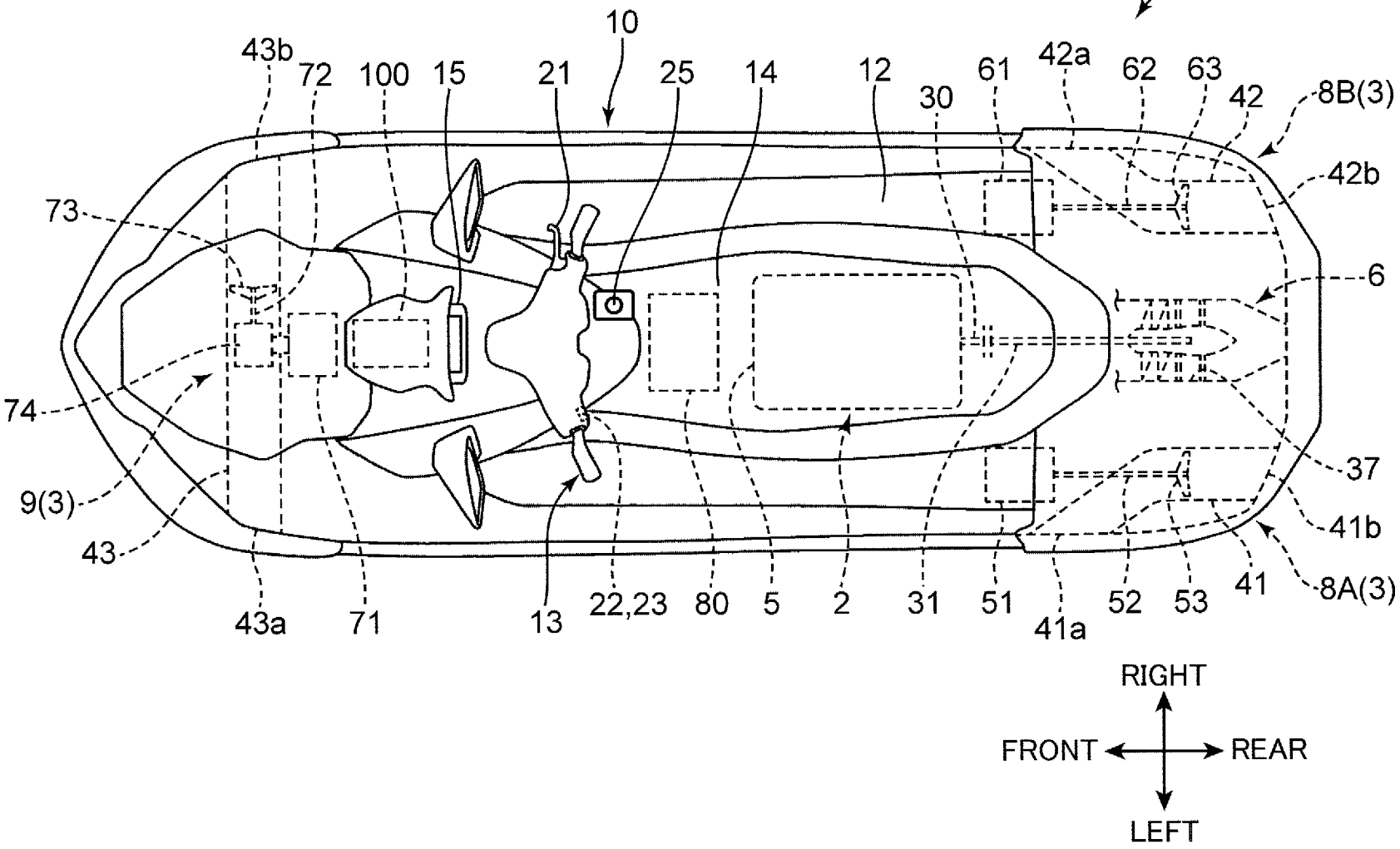
FIG. 2 is a plan view of the jet propulsion boat.

FIG. 1 is a partially broken side view of a jet propulsion boat 1 according to a first embodiment of the present disclosure, and FIG. 2 is a plan view of the jet propulsion boat 1. The jet propulsion boat 1 jets a water flow backward to move on the water in reaction to the water flow. The jet propulsion boat 1 according to the present embodiment is a straddle-type personal watercraft also called PWC. Thus, the jet propulsion boat 1 is abbreviated below as a PWC 1.

The PWC 1 includes an engine 5 and an electric motor for driving a propulsion device that imparts propulsion force to a boat body 10. The PWC 1 in the present embodiment includes a plurality of electric motors 51, 61, 71 for driving the propulsion device. The propulsion device includes a first propulsion device 2, and a second propulsion device 3 that imparts propulsion force different from that of the first propulsion device 2 to the boat body 10. The first propulsion device 2 is an engine type propulsion device, and is driven by the engine 5. The second propulsion device 3 is an electric propulsion device, and is driven by electric motors 51, 61, and 71.

The boat body 10 includes a hull 11 and a deck 12 overlying the hull 11.

The deck 12 is provided with a handle 13, the seat 14, and a display 15. The handle 13 is a steering handle operated by the driver M for steering the PWC 1. The seat 14 allows a driver M who drives the PWC 1 to sit thereon. The seat 14 may be a seat on which at least the driver M can sit. That is, the seat 14 may be a multi-seat on which not only the driver M but also a fellow passenger can sit, or may be a single-seat on which only the driver M can sit. The display 15 displays various types of information regarding operation of the PWC 1, such as moving speed, a remaining amount of fuel, and an operation mode. The display 15 in the present embodiment is a touch panel type display that allows various input operations to be performed on the display 15. The display 15 corresponds to a "display unit" in the present disclosure.

The first propulsion device 2 includes a jet pump 6 that is driven by the engine 5 and injects water, and a reverse bucket 7 (FIG. 1) disposed at an outlet part of the jet pump 6.

The engine 5 is an internal combustion engine. The engine 5 is a power source that generates power for driving the jet pump 6, and includes, for example, a water-cooled four-stroke multicylinder engine using gasoline as fuel. The engine 5 is accommodated in an engine room ER formed inside the hull 11. The engine 5 includes a crank shaft 30 extending in a longitudinal direction (front-rear direction) as an output shaft.

The engine 5 has maximum output, or the first propulsion device 2 has maximum output, the maximum output being set to a value that allows the PWC 1 to move in a planing state with propulsion force generated by a jet water flow from the jet pump 6. That is, the first propulsion device 2 is a main propulsion device which has relatively high output and is capable of moving the PWC 1 in a planing state in which the boat body 10 is inclined in a direction in which the bow rises. The propulsion force described above that can be generated by the first propulsion device 2 is larger than that of the second propulsion device 3 that is an electric auxiliary propulsion device.

The boat body 10 includes an impeller passage 37. The impeller passage 37 includes a water suction port 36 as an inlet, the water suction port 36 being formed at the center in a width direction of a bottom surface 11A of the hull 11. The impeller passage 37 is formed to pass through a rear part of the hull 11 in the longitudinal direction.

The jet pump 6 is disposed in the impeller passage 37. The jet pump 6 generates a jet water flow: The jet pump 6 generates a jet water flow by pressurizing and accelerating the water taken into the impeller passage 37 from the water suction port 36, and injects the generated jet water flow backward from the boat body 10. This backward injection of the jet water flow generates propulsion force for moving the boat body 10 forward.

The jet pump 6 includes a pump shaft 31, a pump impeller 32, and a jet nozzle 35.

The pump shaft 31 is coaxially coupled to a rear end of the crank shaft 30. Driving force of the engine 5 is transmitted to the pump impeller 32 via the crank shaft 30 and the pump shaft 31. Upon receiving the driving force, the pump impeller 32 rotates about its axis to generate a jet water flow:

The jet nozzle 35 includes an injection port 39 for injecting a jet water flow generated by the pump impeller 32, and is disposed in a rear end part of the boat body 10. The jet nozzle 35 is supported by the boat body 10 to be capable of swinging from the left to right. The jet nozzle 35 is linked with the handle 13 via a cable or the like to swing from the left to right in response to steering of the handle 13. When the jet nozzle 35 is swung using the handle 13, an injection direction of a jet water flow from the injection port 39 is changed to the left and right, thereby changing a traveling direction of the PWC 1. The traveling direction can be changed using the handle 13 during movement (mainly during planing) using the first propulsion device 2 of an engine type, and the movement always involves movement in the longitudinal direction.

In contrast, during movement using the second propulsion device 3 of an electric type, the traveling direction is changed by operating an operation lever 25 to be described later instead of operating the handle 13. Although details will be described later, the second propulsion device 3 can move the PWC 1 not only in a non-planing state, but also in a direction other than the longitudinal direction, i.e., in a lateral direction (left-right direction).

Here, the jet nozzle 35 has a rightward swing angle with respect to the longitudinal direction, the rightward swing angle being smaller than 90 degrees, and a leftward swing angle with respect to the longitudinal direction of the jet nozzle 35, the leftward swing angle being smaller than 90 degrees.

The reverse bucket 7 is supported by the boat body 10 to be rotatable in an up-down direction of the PWC 1. Specifically, the reverse bucket 7 is movable between a forward position illustrated in FIG. 1 at which the reverse bucket 7 is rotated upward without covering the injection port 39 of the jet nozzle 35 and a reverse position at which the reverse bucket 7 is rotated downward to cover the injection port 39 of the jet nozzle 35 from behind. When the reverse bucket 7 is at the forward position (FIG. 1), the PWC 1 moves forward, and when the reverse bucket 7 is at the reverse position, the PWC 1 moves backward. The deck 12 is provided with a shift lever 23 (FIG. 6) switching the reverse bucket 7 between the forward position and the reverse position. Specifically, the shift lever 23 is for operating a motor for switching the reverse bucket 7 between the respective positions.

The handle 13 is disposed above a front part of the deck 12. As illustrated in FIG. 2, the handle 13 is provided with an accelerator 21 and a start and stop switch 22.

The accelerator 21 is a device for adjusting moving speed of the PWC 1 by increasing or decreasing output of the engine 5 when the PWC 1 moves using the first propulsion device 2 of an engine type.

The start and stop switch 22 is for changing an energized state of various electric components (excluding the electric motors 51, 61, 71) in the boat body 10 and a driving state of the first propulsion device 2 (the engine 5) or the second propulsion device 3 (the electric motors 51, 61, 71). The start and stop switch 22 is provided at a position opposite to the accelerator 21 (left side) on the handle 13.

The start and stop switch 22 in the present embodiment is configured by a push button switch. When the start and stop switch 22 is pressed while energization of electric components is stopped, the energization of the electric components is started, or the energization of the electric components is started and the first propulsion device 2 (engine 5) is started. Operation of starting only energization to each electric component is different from operation of starting energization to each electric component and starting the first propulsion device 2 (engine 5). For example, the first propulsion device 2 (engine 5) is started when a so-called long press is performed in which the start and stop switch 22 is continuously pressed for a predetermined time. In contrast, when the start and stop switch 22 is pressed for a time shorter than the predetermined time, only energization to the electric components is started. Driving of the second propulsion device 3 (the electric motors 51, 61, 71) is started as each control corresponding to the electric mode is performed as described later. When the start and stop switch 22 is pressed while the first propulsion device 2 or the second propulsion device 3 is driven, energization to the propulsion device 2 (3) driven and the electric components is stopped.

The boat body 10 can be navigated only when each electric component is energized, so that a state where each electric component is energized is appropriately referred below to as a navigable state. Then, a state where each electric component is not energized is appropriately referred below to as an unnavigable state.

The start and stop switch 22 is detachably connected to one end of a tether 90 having a cord shape. The tether 90 is connected to the start and stop switch 22 to be able to operate the start and stop switch 22. Specifically, when the tether 90 is removed from the start and stop switch 22 to release the connection between the tether 90 and the start and stop switch 22 while the engine 5 is driven in the navigable state, the start and stop switch 22 is operated to stop the engine 5. The other end of the tether 90 is engaged with a driver M1. As a result, when the driver M1 falls and the tether 90 falls off the start and stop switch 22 while the engine 5 is driven, the engine 5 is stopped. Even when the engine 5 is stopped due to release of the connection between the tether 90 and the start and stop switch 22, the navigable state is maintained to maintain energization to each electric component.

Figure 3:
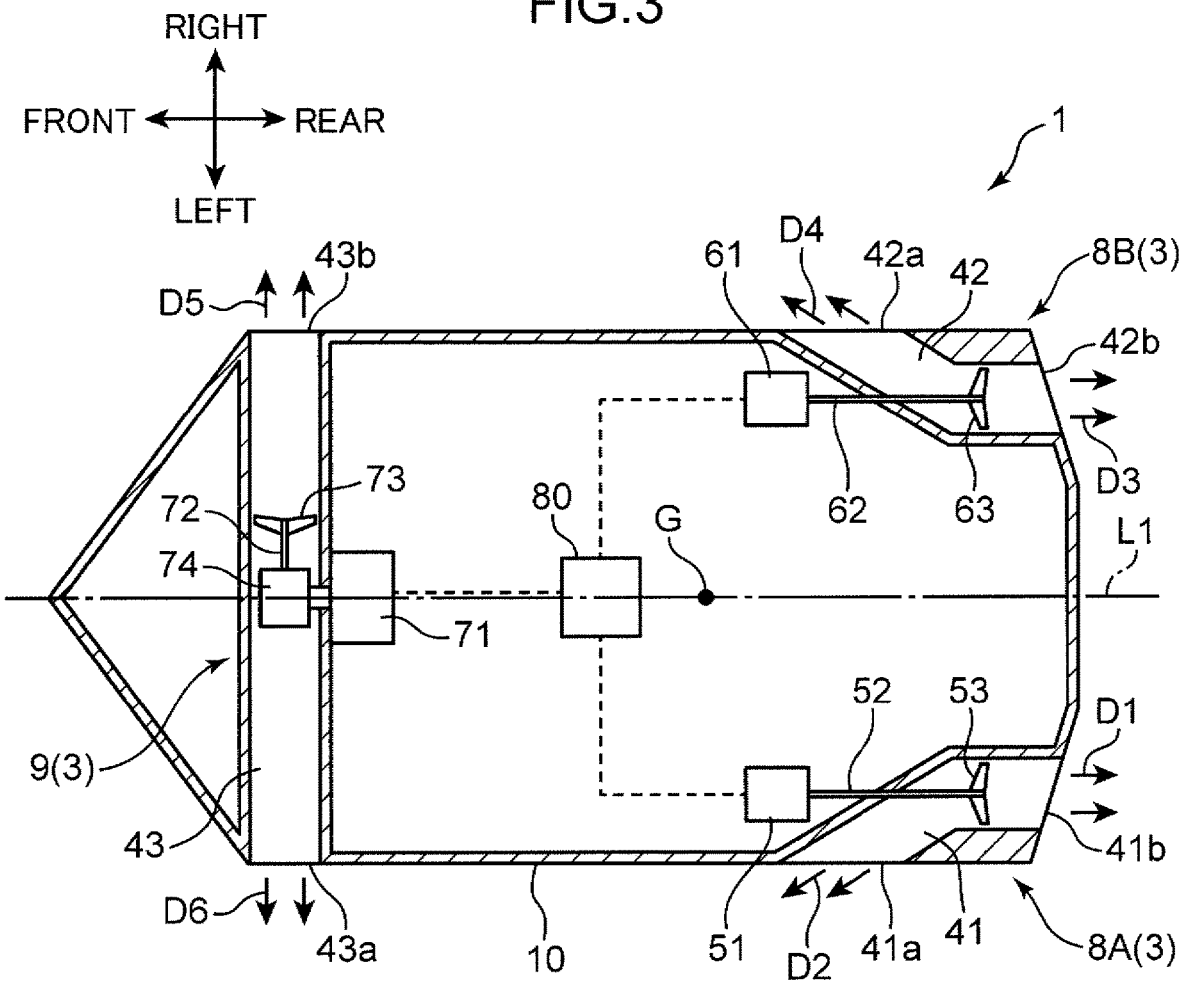
FIG. 3 is a plan sectional view schematically illustrating structure of a second propulsion device of the jet propulsion boat.

FIG. 3 is a plan sectional view schematically illustrating structure of the second propulsion device 3. As mainly illustrated in FIGS. 2 and 3, the second propulsion device 3 includes a plurality of thrusters 8A, 8B, 9 of an electric type. Specifically, the second propulsion device 3 includes a pair of left and right longitudinal thrusters 8A, 8B, and disposed in a rear part of the boat body 10 and the lateral thruster 9 disposed at a front part of the boat body 10. The thrusters 8A, 8B, 9 are driven by the electric motors 51, 61, 71, respectively. The second propulsion device 3 in the present embodiment is an auxiliary propulsion device prepared to move the PWC 1 at a low speed and with low noise. As described above, the second propulsion device 3 can generate propulsion force that is smaller than propulsion force that can be generated by the first propulsion device 2. The electric motor for driving the second propulsion device 3 (each thruster 8A, 8B, 9) correspondingly has a maximum output set to be lower than a maximum output of the engine 5 for driving the first propulsion device 2. Specifically, a maximum output of the whole of the electric motors 51, 61, 71, i.e., a total value of maximum outputs of the respective electric motors 51, 61, 71, is set to be lower than the maximum output of the engine 5. This configuration allows vibration and noise generated when the electric motor for driving the second propulsion device 3 is driven at the maximum output to be smaller than vibration and noise generated when the engine 5 for driving the first propulsion device 2 is driven at the maximum output. The electric motors 51, 61, 71 in the present embodiment have the respective maximum outputs that are set to be equal to each other.

The pair of longitudinal thrusters 8A, 8B generate propulsion force for moving the boat body 10 in the longitudinal direction. The longitudinal thruster 8A is disposed on the left side of the jet pump 6, i.e., in a left rear part of the boat body 10. The longitudinal thruster 8B is disposed on the right side of the jet pump 6. i.e., in a right rear part of the boat body 10. In other words, the pair of longitudinal thrusters 8A, 8B are respectively disposed on left and right side parts of the rear part of the boat body 10 to be disposed on the left and right across a center axis L1 (FIG. 3) of the boat body 10 extending in the longitudinal direction. Alternatively, the pair of longitudinal thrusters 8A, 8B are disposed at respective positions displaced from each other in different directions with respect to the center of gravity G (FIG. 3) of the PWC 1. The pair of longitudinal thrusters 8A, 8B in the present embodiment are respectively disposed on the left and right side parts of the boat body 10 to be symmetrical with respect to the center axis L1 or the center of gravity G of the PWC 1. The longitudinal thruster 8A on the left side is referred below to as a left longitudinal thruster 8A, and the longitudinal thruster 8B on the right side is referred below to as a right longitudinal thruster 8B as appropriate.

The left longitudinal thruster 8A includes a propeller shaft 52 and an impeller 53, and is driven by the electric motor 51. Specifically, the electric motor 51 rotationally drives the impeller 53. The propeller shaft 52 couples the electric motor 51 to the impeller 53. The impeller 53 rotates by receiving driving force of the electric motor 51, and generates a water flow using the rotation. The electric motor 51 that drives the left longitudinal thruster 8A is appropriately referred below to as a first electric motor 51.

The boat body 10 includes a left water passage 41 at a position corresponding to the left longitudinal thruster 8A. The left water passage 41 passes through a left rear part of the hull 11 in the longitudinal direction to allow a front opening 41*a* opened on a left side surface of the rear part of the hull 11 to communicate with a rear opening 41*b* opened on a rear surface of the hull 11 as illustrated in FIG. 3. The front opening 41*a* opens diagonally forward left. i.e., forward and leftward, and the rear opening 41*b* opens substantially straight backward. In other words, the left water passage 41 is a bent or curved passage including a first part extending obliquely backward from the front opening 41*a* and a second part extending backward from a rear end of the first part to reach the rear opening 41*b*. The rear opening 41*b* is opened parallel to a corresponding opening (rear opening 42*b* to be described later) of the right longitudinal thruster 8B.

The propeller shaft 52 has a rear part inserted into the left water passage 41. The impeller 53 is attached to a rear end of the propeller shaft 52, and is accommodated inside the left water passage 41 in a state of being rotatable around an axis of the propeller shaft 52. The driving force of the first electric motor 51 is transmitted to the impeller 53 via the propeller shaft 52 to rotate the impeller 53 around its axis. The impeller 53 is rotated to cause water introduced into the left water passage 41 to be injected from one end (the front opening 41*a* or the rear opening 41*b*) of the left water passage 41 to generate a water flow flowing in the longitudinal direction. In other words, the left longitudinal thruster 8A is disposed in a posture in which an injection axis of the water flow: i.e., the axis of the impeller 53, faces the longitudinal direction.

The first electric motor 51 in the present embodiment can perform a forward rotation operation of rotating the impeller 53 in a direction causing a backward water flow to be generated and a reverse rotation operation of rotating the impeller 53 in a direction causing a forward water flow to be generated. During the forward rotation of the first electric motor 51, the water flow generated by the impeller 53 is injected backward from the rear opening 41*b* of the left water passage 41 as indicated by an arrow D1 in FIG. 3. This backward injection of the water flow imparts forward propulsion force to the boat body 10 to move the boat body 10 forward. In contrast, during the reverse rotation of the first electric motor 51, the water flow generated by the impeller 53 is injected obliquely forward from the front opening 41*a* of the left water passage 41 as indicated by an arrow D2 in FIG. 3. This forward injection of the water flow imparts backward propulsion force to the boat body 10 to move the boat body 10 backward. As described above, the left longitudinal thruster 8A can be switched between a backward injection mode in which a water flow is injected backward to impart forward propulsion force to the boat body 10 and a forward injection mode in which a water flow is injected forward to impart backward propulsion force to the boat body 10.

The right longitudinal thruster 8B also has structure similar to that of the left longitudinal thruster 8A. That is, the right longitudinal thruster 8B includes a propeller shaft 62 and an impeller 63, and is driven by the electric motor 61. The electric motor 61 that drives the right longitudinal thruster 8B is appropriately referred below to as a second electric motor 61.

The boat body 10 includes a right water passage 42 at a position corresponding to the right longitudinal thruster 8B. The right water passage 42 passes through a right rear part of the hull 11 in the longitudinal direction, and has a shape symmetrical to the left water passage 41 described above. That is, the right water passage 42 allows the front opening 42*a* opened in a right side surface of the rear part of the hull 11 to communicate with the rear opening 42*b* opened on the rear surface of the hull 11. The front opening 42*a* opens diagonally forward right, and the rear opening 42*b* opens substantially straight backward.

The propeller shaft 62 has a rear part inserted into the right water passage 42. The impeller 63 is attached to a rear end of the propeller shaft 62, and is accommodated inside the right water passage 42 in a state of being rotatable around an axis of the propeller shaft 62. The impeller 63 is rotationally driven by the second electric motor 61 to generate a water flow in the longitudinal direction through the right water passage 42. In other words, the right longitudinal thruster 8B is disposed in a posture in which an injection axis of the water flow; i.e., the axis of the impeller 63, faces the longitudinal direction.

Similarly to the first electric motor 51 of the left longitudinal thruster 8A described above, the second electric motor 61 can perform forward rotation and reverse rotation. During the forward rotation of the second electric motor 61, a water flow is injected backward from the rear opening 42*b* of the right water passage 42 to impart forward propulsion force to the boat body 10 (backward injection mode) as indicated by an arrow D3 in FIG. 3. In contrast, during the reverse rotation of the second electric motor 61, a water flow is injected diagonally forward from the front opening 42*a* of the right water passage 42 to impart backward propulsion force to the boat body 10 (forward injection mode) as indicated by an arrow D4 in FIG. 3.

Here, the left longitudinal thruster 8A and the right longitudinal thruster 8B are disposed symmetrically across the center axis L1 of the boat body 10 (or the center of gravity G of the PWC 1). Thus, when only one of the thrusters 8A, 8B injects a water flow: turning force acts on the boat body 10. For example, when only the left longitudinal thruster 8A is driven in the backward injection mode, forward propulsion force is generated in a left side part of the boat body 10, and as a result, turning force for rotating the boat body 10 clockwise acts on the boat body 10. Similarly, when only the right longitudinal thruster 8B is driven in the backward injection mode, forward propulsion force is generated in a right side part of the boat body 10, and as a result, turning force for rotating the boat body 10 counterclockwise acts on the boat body 10. In contrast, when both the left and right longitudinal thrusters 8A, 8B are driven at equal output in the backward injection mode, turning forces of the longitudinal thrusters 8A, 8B are mutually cancelled, and thus substantially no turning force acts on the boat body 10. The same applies to the forward injection mode.

The lateral thruster 9 generates propulsion force for moving the boat body 10 in the lateral direction (width direction). The lateral thruster 9 is disposed near a front end part of the boat body 10, the front end part being positioned in front of the handle 13.

The lateral thruster 9 includes a propeller shaft 72, an impeller 73, and a gear mechanism 74, and is driven by the electric motor 71. The gear mechanism 74 is a bevel gear mechanism linked with an output shaft of the electric motor 71. The propeller shaft 72 couples the gear mechanism 74 to the impeller 73. The gear mechanism 74 receives rotation from the electric motor 71 and changes a direction of the rotation by 90 degrees, and then transmitted the rotation to the impeller 73. As a result, the impeller 73 is rotated, and a water flow is generated by the rotation of the impeller 73. The electric motor 71 that drives the lateral thruster 9 is appropriately referred below to as a third electric motor 71.

The boat body 10 includes a front water passage 43 at a position corresponding to the lateral thruster 9. The front water passage 43 passes through a front part of the hull 11 in the lateral direction to allow a left opening 43*a* opened in a left side surface of the front part of the hull 11 to communicate with a right opening 43*b* opened in a right side surface of the front part of the hull 11 and as illustrated in FIG. 3.

The third electric motor 71 is disposed inside the hull 11 behind the front water passage 43. Then, the propeller shaft 72, the impeller 73, and the gear mechanism 74 are accommodated inside the front water passage 43. The driving force of the third electric motor 71 is transmitted to the impeller 73 via the gear mechanism 74 and the propeller shaft 72 to rotate the impeller 73 around its axis. The impeller 73 is rotated to cause water introduced into the front water passage 43 to be injected from one end (the left opening 43*a* or the right opening 43*b*) of the front water passage 43 to generate a water flow flowing in the lateral direction. In other words, the lateral thruster 9 is disposed in a posture in which an injection axis of the water flow, i.e., the axis of the impeller 73, faces the lateral direction.

The third electric motor 71 in the present embodiment can perform a forward rotation operation of rotating the impeller 73 in a direction causing a rightward water flow to be generated and a reverse rotation operation of rotating the impeller 73 in a direction causing a leftward water flow to be generated. During the forward rotation of the third electric motor 71, the water flow generated by the impeller 73 is injected rightward from the right opening 43*b* of the front water passage 43 as indicated by an arrow D5 in FIG. 3. This rightward injection of the water flow imparts leftward propulsion force to the boat body 10 to move the boat body 10 leftward. In contrast, during the reverse rotation of the third electric motor 71, the water flow generated by the impeller 73 is injected leftward from the left opening 43*a* of the front water passage 43 as indicated by an arrow D6 in FIG. 3. This leftward injection of the water flow imparts rightward propulsion force to the boat body 10 to move the boat body 10 rightward. As described above, the lateral thruster 9 can be switched between a rightward injection mode in which a water flow is injected rightward to impart leftward propulsion force to the boat body 10 and a leftward injection mode in which a water flow is injected leftward to impart rightward propulsion force to the boat body 10.

Here, the lateral thruster 9 is disposed in front of the center of gravity G of the PWC 1. Thus, when the lateral thruster 9 is driven in the rightward injection mode or the leftward injection mode, a turning force acts on the boat body 10. For example, when the lateral thruster 9 is driven in the rightward injection mode, leftward propulsion force is generated in the front part of the boat body 10, and as a result, turning force for rotating the boat body 10 counterclockwise acts on the boat body 10. Alternatively, when the lateral thruster 9 is driven in the leftward injection mode, rightward propulsion force is generated in the front part of the boat body 10, and as a result, turning force for rotating the boat body 10 clockwise acts on the boat body 10.

As described above, the left longitudinal thruster 8A and the right longitudinal thruster 8B each can impart forward propulsion force and backward propulsion force to the boat body 10. Additionally, the left longitudinal thruster 8A and the right longitudinal thruster 8B can impart propulsion forces in respective directions opposite to each other, i.e., in respective directions different from each other, to the boat body 10. That is, the right longitudinal thruster 8B can impart forward (rearward) propulsion force to the boat body 10 while the left longitudinal thruster 8A imparts forward (rearward) propulsion force to the boat body 10. Then, the lateral thruster 9 can impart rightward propulsion force and leftward propulsion force to the boat body 10. This configuration enables the second propulsion device 3 to impart propulsion force in a plurality of directions including forward, backward, rightward, and leftward directions to the boat body 10. Then, the second propulsion device 3 can adjust a traveling direction of the boat body 10 by adjusting a magnitude of propulsion force of each of the three thrusters 8A, 8B, 9.

As described above, the first propulsion device 2 generates propulsion force in directions including a forward direction, a backward direction, and an obliquely backward direction that is less than 90 degrees to the left or right with respect to the longitudinal direction. In contrast, the lateral thruster 9 can generate rightward propulsion force and leftward propulsion force, i.e., propulsion force in an angular direction of 90 degrees to the left or right with respect to the longitudinal direction, and the second propulsion device 3 can impart the propulsion force in a direction different from that of the first propulsion device 2 to the boat body 10.

The boat body 10 is equipped with a battery 80 that supplies electric power to the electric motors 51, 61, 71. The electric motors 51, 61, 71 are rotationally driven by receiving the electric power from the battery 80. The battery 80, which is common in the present embodiment, supplies the electric power to the electric motors 51, 61, 71. The boat body 10 is also equipped with an auxiliary battery (not illustrated) separately from the battery 80 in the present embodiment, and is configured to allow the auxiliary battery to supply electric power to various electric components in the boat body 10 except for the electric motors 51, 61, 71. Instead of this configuration, a common battery may supply electric power to the electric motors 51, 61, 71 and the other electric components.

Figure 4:
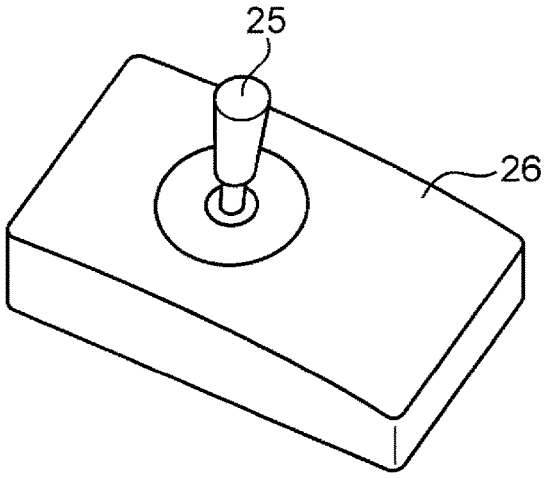
FIG. 4 is a perspective view illustrating an operation lever for operating the second propulsion device.

As illustrated in FIG. 2, the operation lever 25 is provided near the handle 13 in the deck 12. The operation lever 25 is configured to adjust a traveling direction and speed when the PWC 1 is moved using the second propulsion device 3 of an electric type. As illustrated in FIG. 4, the operation lever 25 in the present embodiment is a so-called joystick, and is supported by a base 26 in a state tiltable in any direction including front, back, left, and right from a neutral position. Specifically, the operation lever 25 has a substantially cylindrical columnar shape, and is supported by the base 26 while having a center axis extending substantially perpendicularly to the base 26 at the neutral position.

Figure 6:
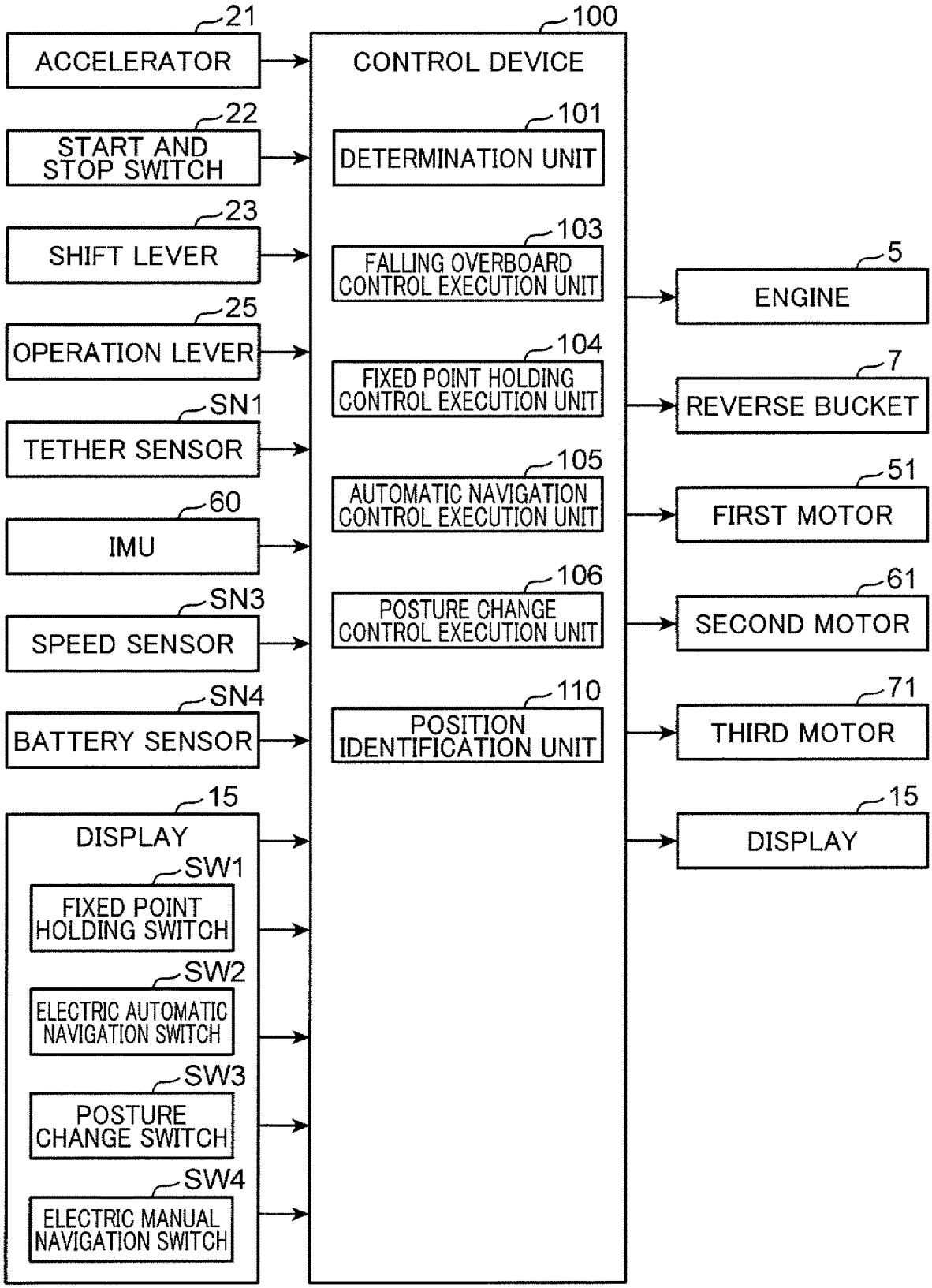
FIG. 6 is a functional block diagram illustrating a control system of a jet propulsion boat.

FIG. 5 illustrates the relationship between a tilting direction of the operation lever 25 and an operation (traveling direction) of the PWC 1, and a control mode of the second propulsion device 3 (each of the thrusters 8A, 8B, 9) in each operation mode, in a table format. With reference to FIG. 6, operation of the PWC 1 and control of the second propulsion device 3 will be described for each tilting direction of the operation lever.

(Forward Movement)

When the operation lever 25 is tilted forward, the PWC 1 is moved forward. During the forward movement of the PWC 1, the left longitudinal thruster 8A and the right longitudinal thruster 8B are each driven in the backward injection mode in which a water flow is injected backward. That is, the first electric motor 51 and the second electric motor 61 are each driven to rotate forward. Then, the lateral thruster 9) (third electric motor 71) is stopped. As a result, forward propulsion force acts on the boat body 10 to move the PWC 1 forward. Specifically, during the forward movement of the PWC 1, the left and right longitudinal thrusters 8A, 8B each inject a water flow backward at equal output. As a result, turning forces about the center of gravity G for the PWC 1 caused by propulsion forces of the respective thrusters 8A, 8B are mutually canceled, and thus the PWC 1 is moved straight forward.

(Backward Movement)

When the operation lever 25 is tilted backward, the PWC 1 is moved backward. During the backward movement of the PWC 1, the left longitudinal thruster 8A and the right longitudinal thruster 8B are each driven in the forward injection mode in which a water flow is injected forward. That is, the first electric motor 51 and the second electric motor 61 are each driven to rotate reversely. Then, the lateral thruster 9) (third electric motor 71) is stopped. As a result, backward propulsion force acts on the boat body 10 to move the PWC 1 backward. Specifically, during the backward movement of the PWC 1, the left and right longitudinal thrusters 8A, 8B each inject a water flow forward at equal output. As a result, turning forces about the center of gravity G for the PWC 1 caused by propulsion forces of the respective thrusters 8A, 8B are mutually canceled, and thus the PWC 1 is moved straight backward.

(Clockwise Turning)

When the operation lever 25 is tilted diagonally forward right, the PWC 1 is turned clockwise. During the clockwise turning of the PWC 1, at least the left longitudinal thruster 8A is driven in the backward injection mode. That is, the first electric motor 51 is driven to rotate forward. Then, the right longitudinal thruster 8B is stopped or driven in the backward injection mode at smaller propulsion force than the left longitudinal thruster 8A (first electric motor 51). That is, the second electric motor 61 is stopped or driven to rotate forward with smaller output than the first electric motor 51. As a result, forward propulsion force acts on the boat body 10, and turning force for turning the boat body 10 clockwise is generated, and thus the PWC 1 is moved diagonally forward right. That is, the PWC 1 is turned clockwise.

When a clockwise turning instruction angle, i.e., a right component of the inclination of the operation lever 25 operated diagonally forward right, is large, the lateral thruster 9 is also used. Specifically, when the clockwise turning instruction angle is larger than a predetermined value, the lateral thruster 9 is driven in the leftward injection mode in which a water flow is injected leftward. That is, the third electric motor 71 is driven to rotate reversely. As a result, clockwise turning force is increased to turn the PWC 1 clockwise by a relatively large angle. In contrast, when the clockwise turning instruction angle is smaller than the predetermined value, the lateral thruster 9 (third electric motor 71) is stopped.

(Counterclockwise Turning)

When the operation lever 25 is tilted diagonally forward left, the PWC 1 is turned counterclockwise. During the counterclockwise turning of the PWC 1, at least the right longitudinal thruster 8B is driven in the backward injection mode. That is, the second electric motor 61 is driven to rotate forward. Then, the left longitudinal thruster 8A is stopped or driven in the backward injection mode with smaller propulsion force than the right longitudinal thruster 8B. That is, the first electric motor 51 is stopped or driven to rotate forward with smaller output than the second electric motor 61. As a result, forward propulsion force acts on the boat body 10, and turning force for turning the boat body 10 counterclockwise is generated, and thus the PWC 1 is moved diagonally forward left. That is, the PWC 1 is turned counterclockwise.

When a counterclockwise turning instruction angle, i.e., a left component of the inclination of the operation lever 25 operated diagonally forward left, is large, the lateral thruster 9 is also used. Specifically, when the counterclockwise turning instruction angle is larger than a predetermined value, the lateral thruster 9 is driven in the rightward injection mode in which a water flow is injected rightward. That is, the third electric motor 71 is driven to rotate forward. As a result, counterclockwise turning force is increased to turn the PWC 1 counterclockwise by a relatively large angle. In contrast, when the counterclockwise turning instruction angle is smaller than the predetermined value, the lateral thruster 9) (third electric motor 71) is stopped.

(Rightward Sliding)

When the operation lever 25 is tilted rightward, the PWC 1 is slid rightward. During the rightward sliding of the PWC 1, the lateral thruster 9) is driven in the leftward injection mode, and the right longitudinal thruster 8B is driven in the backward injection mode with relatively small propulsion force. That is, the third electric motor 71 is driven to rotate reversely, and the second electric motor 61 is driven to rotate forward with relatively small output. Then, the left longitudinal thruster 8A (first electric motor 51) is stopped. Leftward injection of the lateral thruster 9 imparts rightward propulsion force to the boat body 10. The leftward injection of the lateral thruster 9 also generates turning force of turning the boat body 10 clockwise. However, this turning force is canceled by backward injection of the right longitudinal thruster 8B. As a result, the PWC 1 is slid rightward.

(Leftward Sliding)

When the operation lever 25 is tilted leftward, the PWC 1 is slid leftward. During the leftward sliding of the PWC 1, the lateral thruster 9 is driven in the rightward injection mode, and the left longitudinal thruster 8A is driven in the backward injection mode with relatively small propulsion force. That is, the third electric motor 71 is driven to rotate forward, and the first electric motor 51 is driven to rotate forward with relatively small output. Then, the right longitudinal thruster 8B (second electric motor 61) is stopped. Rightward injection of the lateral thruster 9 imparts leftward propulsion force to the boat body 10. The rightward injection of the lateral thruster 9) also generates turning force of turning the boat body 10 counterclockwise. However, this turning force is canceled by backward injection of the left longitudinal thruster 8A. As a result, the PWC 1 is slid leftward.

Although not illustrated in FIG. 5, the operation lever 25 can also be tilted obliquely backward. That is, when the operation lever 25 is tilted diagonally backward right, the PWC 1 is moved diagonally backward right, and when the operation lever 25 is tilted diagonally backward left, the PWC 1 is moved diagonally backward left. The second propulsion device 3 has a driving mode in each case, the driving mode being similar to that during the clockwise turning and the counterclockwise turning illustrated in FIG. 5 except that the left and right longitudinal thrusters 8A, 8B each cause forward injection instead of backward injection.

When the PWC 1 is moved in each direction described above using the second propulsion device 3, moving speed of the PWC 1 can be adjusted by a tilt angle of the operation lever 25. For example, when the PWC 1 is moved forward, the moving speed of the PWC 1 is adjusted to increase as a forward tilting angle of the operation lever 25 increases. The moving speed is adjusted by increasing or decreasing rotation speed (output) of the electric motors 51, 61, 71 that drive the thrusters 8A, 8B, 9, respectively.

The first propulsion device 2 and the second propulsion device 3 configured as described above are not simultaneously driven, and an operation mode of the PWC 1 is switched between an engine mode and an electric mode in accordance with a condition, the engine mode causing the first propulsion device 2 to be driven by the engine 5 to allow the first propulsion device 2 to impart propulsion force to the boat body 10, and the electric mode causing the second propulsion device 3 to be driven by the electric motors 51, 61, 71 to allow the second propulsion device 3 to impart propulsion force to the boat body 10.

[Control System]

A control system of the PWC 1 will be described. The boat body 10 is equipped with a control device 100 for controlling various devices mounted on the boat body 10. FIG. 6 is a functional block diagram illustrating a control system of the PWC 1. The control device 100 includes a main part configured by a microcomputer including a processor (CPU) that performs calculation and memories such as a ROM and a RAM.

The control device 100 receives signals from the respective switches and the like described above. That is, the control device 100 is electrically connected to the accelerator 21, the start and stop switch 22, the shift lever 23, and the operation lever 25. The control device 100 is also electrically connected to the display 15 and receives an input signal from the display 15.

Figure 7:
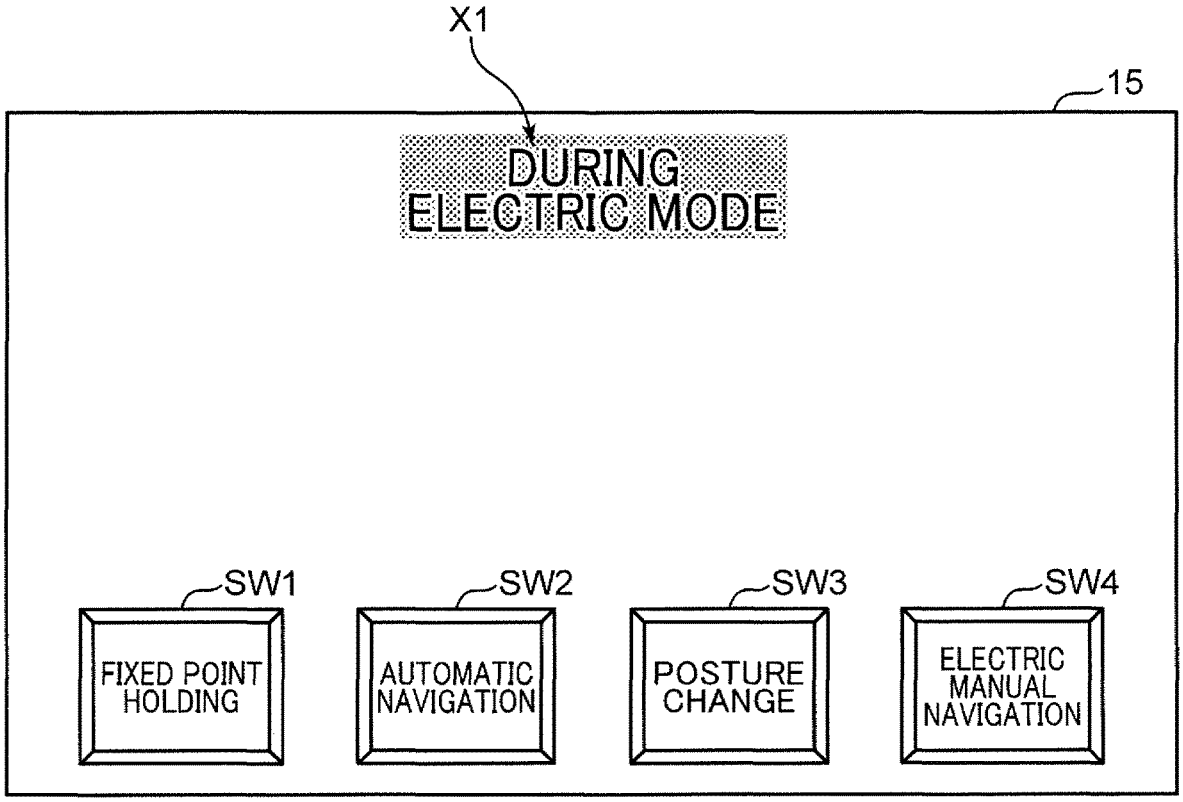
FIG. 7 is a diagram illustrating an example of an image displayed on a display.

FIG. 7 is a diagram illustrating an example of an image displayed on the display 15. As illustrated in FIG. 7, the display 15 displays a fixed point holding switch SW1, an automatic navigation switch SW2, a posture change switch SW3, and an electric manual navigation switch SW4. The fixed point holding switch SW1 is configured to cause the control device 100 to perform fixed point holding control described later. The automatic navigation switch SW2 is configured to cause the control device 100 to perform automatic navigation control described later. The posture change switch SW3 is configured to cause the control device 100 to perform automatic navigation posture change control described later. The electric manual navigation switch SW4 is configured to cause the control device 100 to perform electric manual navigation control described later.

The control device 100 receives an operation signal for each of the switches SW1 to SW4, and determines whether each of the switches SW1 to SW4 is ON or OFF. For example, each of the switches SW1 to SW4 is switched to ON when being pressed in an OFF state, and is switched to OFF when being pressed in an ON state. The control device 100 changes a display format such as brightness of each of the switches SW1 to SW4 on the display 15 between ON and OFF to allow the driver M1 to recognize whether each of the switches SW1 to SW4 is ON or OFF. When the PWC 1 is in the unnavigable state, the switches SW1 to SW4 are each OFF. As a result, each of the switches SW1 to SW4 is switched to ON only by being pressed after the PWC 1 is changed in state from the unnavigable state to the navigable state. The switches SW1 to SW4 are each configured such that when any one of the switches SW1 to SW4 is ON, the other switches cannot be turned ON unless the one switch is switched to OFF.

The display 15 is configured to receive various inputs other than those from the switches SW1 to SW4, and the control device 100 also receives signals of these inputs.

The boat body 10 is equipped with a plurality of detectors. Specifically, the boat body 10 is equipped with a tether sensor SN1, an inertial measurement unit (IMU) 60, a speed sensor SN3, and a battery sensor SN4.

The tether sensor SN1 detects a connection state between the tether 90 and the start and stop switch 22. That is, the tether sensor SN1 detects whether the tether 90 is connected to the start and stop switch 22. The IMU 60 is an inertial measurement device in which a three-axis gyro sensor and a three-axis acceleration sensor are combined, and detects angular velocity around three axes orthogonal to each other and acceleration in three axis directions in the PWC 1. The IMU 60 also can calculate bow azimuth of the boat body 10 based on angular velocity or the like, and thus functions as a device that detects the bow azimuth of the boat body 10. The speed sensor SN3 detects navigation speed of the boat body 10. The battery sensor SN4 detects remaining capacity of the battery 80. The control device 100 also receives signals from these sensors SN1 to SN4. The battery sensor SN4 corresponds to a "remaining battery capacity detector" in the present disclosure.

The control device 100 is electrically connected to the engine 5, the reverse bucket 7 (motor configured to drive the reverse bucket 7), the first electric motor 51, the second electric motor 61, and the third electric motor 71, and outputs control signals to these elements. Regarding control of the engine 5, the control device 100 controls output of the engine 5 and operation of starting and stopping the engine 5 by controlling elements such as a fuel injection device and an ignition plug provided in the engine 5.

The control device 100 outputs a signal for causing the display 15 to display various indications. When the operation mode of the PWC 1 is set to the electric mode, the control device 100 causes the display 15 to display an indication of notifying the driver M1 of the fact. For example, while the operation mode of the PWC 1 is the electric mode, a character string X1, "during electric mode", is displayed on the display 15 as illustrated in FIG. 7. Specifically, when the operation mode of the PWC 1 is set to the electric mode from a state in which the operation mode is not set to any one of the engine mode and the electric mode, or when the operation mode of the PWC 1 is switched from the engine mode to the electric mode, the control device 100 causes the display 15 to display the character string X1 and causes the character string X1 to be hidden when the operation mode of the PWC 1 is switched from the electric mode to the engine mode.

The control device 100 functionally includes a determination unit 101, a falling overboard control execution unit 103, a fixed point holding control execution unit 104, an automatic navigation control execution unit 105, a posture change control execution unit 106, and a position identification unit 110.

The determination unit 101 is a module that performs various kinds of determination regarding control of the PWC 1.

The position identification unit 110 is a module that controls a position of the PWC 10. The position identification unit 110 has a GPS function to identify a current position of the PWC 1 based on a signal from an artificial satellite, for example.

The falling overboard control execution unit 103 is a module that performs falling overboard control. The falling overboard control is for returning the boat body 10 to a position at which the driver M1 has fallen overboard when the driver M1 falls into water.

The fixed point holding control execution unit 104 is a module that performs fixed point holding control. The fixed point holding control is for maintaining the boat body 10 at a fixed position.

The automatic navigation control execution unit 105 is a module that performs automatic navigation control. The automatic navigation control is for moving the boat body 10 toward a target position automatically, i.e., without operation of the driver M1.

The posture change control execution unit 106 is a module that performs posture change control. The posture change control is for changing a posture of the boat body 10.

Figure 8:
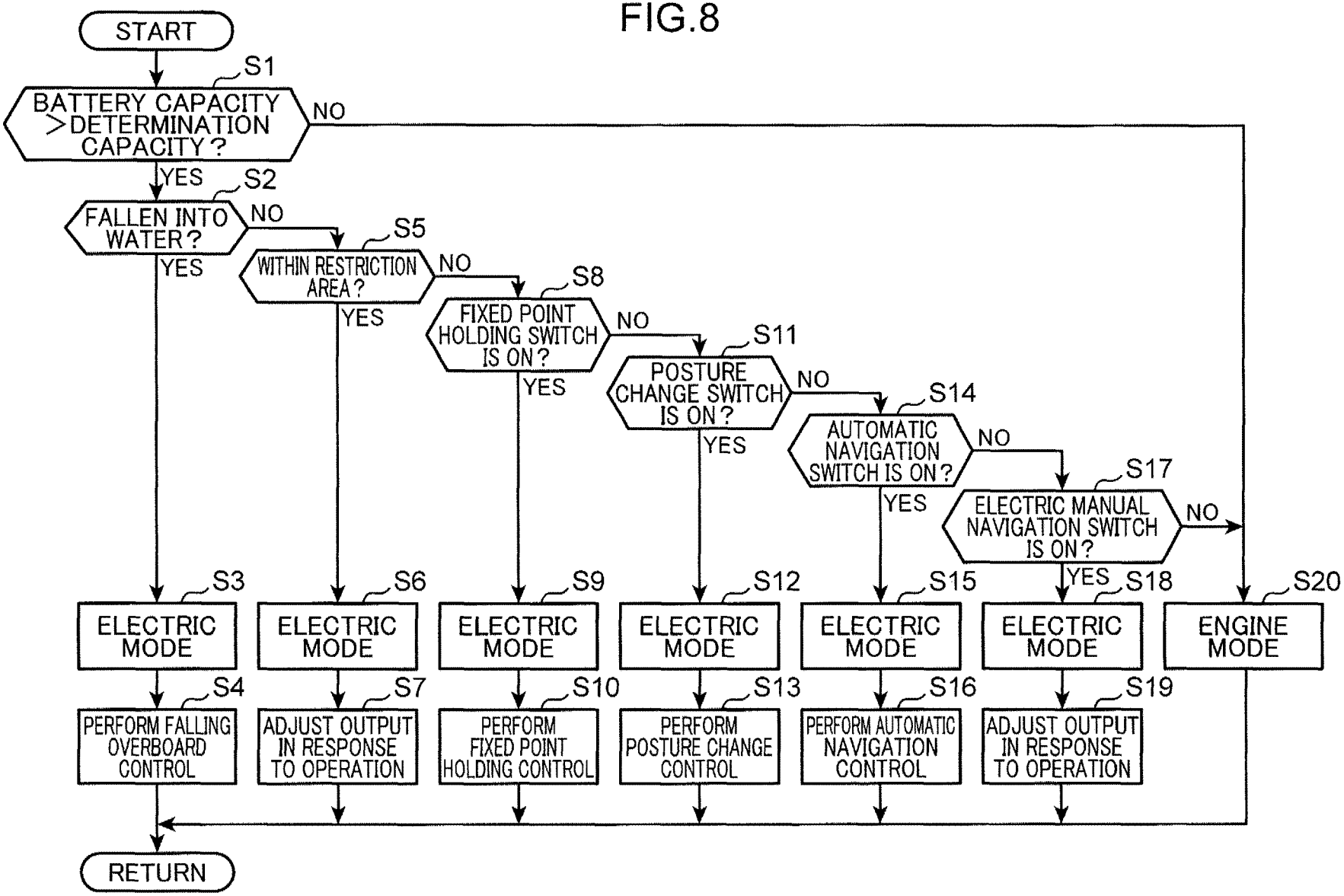
FIG. 8 is a flowchart illustrating contents of control related to mode switching performed by a control device.

Next, control related to switching of the operation mode performed by the control device 100 and each control described above will be described with reference to a flowchart of FIG. 8. FIG. 8 illustrates control that is started when at least the tether 90) is connected to the start and stop switch 22, and the PWC 1 is in the navigable state. The flowchart of FIG. 8 shows steps S1 to S20 that are each repeatedly performed at a predetermined time interval.

When predetermined operation is performed on the start and stop switch 22 as described above in the present embodiment, the first propulsion device 2 (engine 5) is started. Thus, when the above-described operation for starting the first propulsion device 2 (engine 5) is performed on the start and stop switch 22, the control device 100 (determination unit 101) determines the operation mode of the PWC 1 to be the engine mode. Then, the control device 100 performs steps S1 to S20 shown in the flowchart of FIG. 8 in a state where the operation mode of the PWC 1 is determined to be the engine mode. In contrast, when the start and stop switch 22 is operated to start only energization to each electric component, the control device 100 performs steps S1 to S20 illustrated in the flowchart of FIG. 8 in a state where the operation mode of the PWC 1 is not determined to be any one of the engine mode and the electric mode. Then, the operation mode of the PWC 1 is determined as steps S1 to S20 are performed.

When the control shown in FIG. 8 is started, the determination unit 101 determines whether remaining capacity of the battery 80 detected by the battery sensor SN4 is larger than determination capacity (step S1). The determination capacity is preset to a value smaller than 100% and stored in the control device 100.

When NO is determined in step S1 and the remaining capacity of the battery 80 is equal to or less than the determination capacity, the determination unit 101 determines the operation mode of the PWC 1 to be the engine mode (step S20). The control device 100 accordingly controls the engine 5 and the electric motors 51, 61, 71 to perform the engine mode.

Specifically, when the operation mode of the PWC 1 is currently the electric mode and the electric motors 51, 61, 71 are driven, the control device 100 stops the electric motors 51, 61, 71 and starts the engine 5. The electric motors 51, 61, 71 are stopped by stopping power supply from the battery 80 to the electric motors 51, 61, 71. In contrast, when the operation mode of the PWC 1 is currently the engine mode, the engine 5 is already started, and the electric motors 51, 61, 71 are stopped, the control device 100 maintains these states.

Then, when YES is determined in step S1 and the remaining capacity of the battery 80 is larger than the determination capacity, the determination unit 101 then determines whether the driver M1 has fallen into the water (step S2). When the tether sensor SN1 detects release of the connection between the tether 90 and the start and stop switch 22, the determination unit 101 determines that the driver M1 has fallen into the water.

Specifically, when the tether sensor SN1 detects the release of the connection between the tether 90) and the start and stop switch 22, the determination unit 101 determines that the driver M1 has fallen into the water. After that, until the tether sensor SN1 detects reconnection between the tether 90 and the start and stop switch 22, the determination unit 101 determines that the driver M1 has fallen into the water. In contrast, when the tether sensor SN1 detects connection between the tether 90) and the start and stop switch 22, the determination unit 101 determines that the driver M1 has not fallen into the water. As described above, in the present embodiment, the tether sensor SN1 can detect that the driver M1 of the PWC 1 has fallen into the water, and thus the tether sensor SN1 corresponds to a "falling overboard detector" in the present disclosure.

When YES is determined in step S2 and the driver M1 has fallen into the water, the determination unit 101 determines the operation mode of the PWC 1 to be the electric mode (step S3). The control device 100 accordingly controls the engine 5 and the electric motors 51, 61, 71 to perform the electric mode.

Specifically: when the operation mode of the PWC 1 is currently the engine mode and the engine 5 is driven, the control device 100 stops driving of the fuel injection device, the ignition plug, and the like provided in the engine 5 to stop the engine 5. The control device 100 also allows the electric motors 51, 61, 71 to be driven. However, the control device 100 does not necessarily cause all of the three electric motors 51, 61, 71 to be driven, and performs falling overboard control described below to adjust driving and stopping of the three electric motors 51, 61, 71. In contrast, when the operation mode of the PWC 1 is currently the electric mode, the engine 5 is stopped, and the electric motors 51, 61, 71 are already driven, the control device 100 maintains these states.

When YES is determined in step S2 and the driver M1 has fallen into the water, the falling overboard control execution unit 103 performs the falling overboard control (step S4).

When the falling overboard control is started, the falling overboard control execution unit 103 first identifies and stores a falling overboard position at which the driver M1 has fallen into the water. Specifically, the falling overboard control execution unit 103 identifies a current position of the PWC 1 as the falling overboard position, the current position being identified by the position identification unit 110 when the tether sensor SN1 detects release of the connection between the tether 90 and the start and stop switch 22. Then, the falling overboard control execution unit 103 adjusts propulsion force of the second propulsion device 3, i.e., output of each of the electric motors 51, 61, 71 so that the PWC 1 is navigated toward the falling overboard position. For example, the falling overboard control execution unit 103 calculates a route for causing the PWC 1 to arrive at the falling overboard position based on the current position and the falling overboard position of the PWC 1 identified by the position identification unit 110 at the start of the falling overboard control. Then, the falling overboard control execution unit 103 adjusts the outputs of the electric motors 51, 61, 71 so that the PWC 1 moves along the calculated route. The electric motor having output adjusted to zero is stopped driving.

After step S4, the control device 100 returns to step S1. When YES is determined in step S1 and the remaining capacity of the battery 80 is larger than the determination capacity, step S2 and the subsequent steps are performed again. Thus, when it is once determined that the driver M1 has fallen into the water with the battery 80 having remaining capacity larger than the determination capacity, the operation mode of the PWC 1 is maintained in the electric mode until it is determined that the driver M1 has not fallen into the water, and thus the falling overboard control is continued.

Returning to step S2, when NO is determined in step S2 and the driver M1 has not fallen into the water, the determination unit 101 determines whether the PWC 1 is located within a restriction area (step S5).

The determination unit 101 preliminarily stores position information on the restriction area. The determination unit 101 in the present embodiment stores the restriction area in which restriction speed (upper limit speed) of a navigation object is set to a relatively low value by an administration or the like. The determination unit 101 compares a current position of the PWC 1 identified by the position identification unit 110 with the stored position information on the restriction area, and determines that the PWC 1 is located within the restriction area when the current position of the PWC 1 is within the restriction area. In contrast, when the current position of the PWC 1 is outside the restriction area, the determination unit 101 determines that the PWC 1 is not located within the restriction area.

When YES is determined in step S5 and the boat body 10 is located within the restriction area, the determination unit 101 determines the operation mode of the PWC 1 to be the electric mode (step S6). The control device 100 accordingly controls the engine 5 and the electric motors 51, 61, 71 to perform the electric mode.

Specifically, similarly to step S3, when the operation mode of the PWC 1 is currently the engine mode and the engine 5 is driven, the control device 100 stops the engine 5. The control device 100 also allows the electric motors 51, 61, 71 to be driven. However, the control device 100 does not necessarily cause all of the three electric motors 51, 61, 71 to be driven, and adjusts driving and stopping of the three electric motors 51, 61, 71 in response to operation on the operation lever 25 as described below: In contrast, when the operation mode of the PWC 1 is currently the electric mode, the engine 5 is stopped, and the electric motors 51, 61, 71 are already driven, the control device 100 maintains these states.

When YES is determined in step S5 and the boat body 10 is located within the restriction area, the control device 100 adjusts propulsion force of the second propulsion device 3, i.e., output of each of the electric motors 51, 61, 71, in response to operation of the operation lever 25 to change a traveling direction and speed of the boat body 10 (step S7). Specifically, the control device 100 adjusts propulsion force of each of the thrusters 8A, 8B, 9. i.e., output of each of the electric motors 51, 61, 71 to cause a tilting direction of the operation lever 25 and operation (traveling direction) of the boat body 10 to have the relationship illustrated in FIG. 5. The control device 100 also adjusts the propulsion force of each of the thrusters 8A, 8B, 9. i.e., the output of each of the electric motors 51, 61, 71, to cause the boat body 10 to be changed in speed in accordance with a tilting angle of the operation lever 25.

After step S7, the control device 100 returns to step S1. Step S5 and the subsequent steps are performed again when the following conditions are satisfied: YES is determined in step S1 and the battery 80 has remaining capacity larger than the determination capacity; and NO is determined in step S3 and the driver M1 has not fallen into the water. Thus, when the PWC 1 is once determined to be located within the restriction area while the conditions above are satisfied, the operation mode of the PWC 1 is maintained in the electric mode and control based on the operation of the operation lever 25 described above is continued until it is determined that the PWC 1 has moved out of the restriction area.

As described above, determination as to whether the boat body 10 is located within the restriction area is made in the present embodiment based on a current position of the PWC 1 identified by the position identification unit 110 and the position information on the restriction area stored in the determination unit 101, and the position identification unit 110 and the determination unit 101 each correspond to an "area determination unit" of the present disclosure.

Returning to step S5, when NO is determined in step S5 and the boat body 10 is not located within the restriction area, the determination unit 101 determines whether the fixed point holding switch SW1 is ON (step S8). That is, the determination unit 101 determines whether the driver M1 requests the fixed point holding control to be performed, more specifically, whether maintaining the boat body 10 at a fixed position is requested. The determination unit 101 performs the determination based on a signal from the fixed point holding switch SW1.

When YES is determined in step S8, the fixed point holding switch SW1 is ON, and maintaining the boat body 10 at a fixed position is requested, the determination unit 101 determines the operation mode of the PWC 1 to be the electric mode (step S9). The control device 100 accordingly controls the engine 5 and the electric motors 51, 61, 71 to perform the electric mode.

Specifically, similarly to step S3, when the operation mode of the PWC 1 is currently the engine mode and the engine 5 is driven, the control device 100 stops the engine 5. In contrast, when the operation mode of the PWC 1 is currently the electric mode and the engine 5 is stopped, this stop is maintained. The control device 100 also allows the electric motors 51, 61, 71 to be driven. However, the control device 100 does not necessarily cause all of the three electric motors 51, 61, 71 to be driven, and performs fixed point holding control described below to adjust driving and stopping of the three electric motors 51, 61, 71.

When YES is determined in step S8 and the fixed point holding switch SW1 is ON, the fixed point holding control execution unit 104 performs the fixed point holding control (step S10).

When the fixed point holding control is started, the fixed point holding control execution unit 104 first specifies and stores an anchor point that is a current position of the PWC 1 identified by the position identification unit 110 when the fixed point holding switch SW1 is switched from OFF to ON. Then, when a separation distance between the current position of the PWC 1 identified by the position identification unit 110 and the anchor point has a predetermined reference value or more, the fixed point holding control execution unit 104 adjusts propulsion force of the second propulsion device 3, i.e., output of each of the electric motors 51, 61, 71 so that the PWC 1 returns to the anchor point.

Specifically, the fixed point holding control execution unit 104 estimates a direction in which the PWC 1 has been moved with respect to the anchor point based on the current position of the PWC 1 identified by the position identification unit 110 and a detection value of the IMU 2, and adjusts output of the electric motors 51, 61, 71 to cause the PWC 1 to be moved in a direction opposite to the direction estimated to have a separation distance less than the reference value. For example, when the PWC 1 moves leftward with respect to the anchor point, the fixed point holding control execution unit 104 drives the third electric motor 71, and drives the second electric motor 61 with relatively small output to respectively drive the lateral thruster 9 in the leftward injection mode and drive the right longitudinal thruster 8B in the backward injection mode with relatively small output. As a result, the PWC 1 is slid rightward toward the anchor point. The fixed point holding control execution unit 104 also drives the third electric motor 71 and the second electric motor 61 until the separation distance between the current position of the PWC 1 identified by the position identification unit 110 and the anchor point has a value less than the reference value.

After step S10, the control device 100 returns to step S1. Step S8 and subsequent steps are performed again when the following conditions are satisfied: YES is determined in step S1 and the battery 80 has remaining capacity larger than the determination capacity: NO is determined in step S3 and the driver M1 has not fallen into the water; and NO is determined in step S5 and the PWC 1 is not located within the restriction area. Thus, when the fixed point holding switch SW1 is once switched from OFF to ON while the above conditions are satisfied, the operation mode of the PWC 1 is maintained in the electric mode until the fixed point holding switch SW1 is switched to OFF, and thus the fixed point holding control is continued. When the fixed point holding switch SW1 is ON in the present embodiment, in which the battery 80 has remaining capacity equal to or less than the determination capacity (NO is determined in step S1), it is determined that the driver M1 has fallen into the water (YES is determined in step S2), or when the PWC1 is determined to be located within the restriction area (YES is determined in step S5), the fixed point holding switch SW1 is forcibly switched to OFF.

Returning to step S8, when NO is determined in step S8 and the fixed point holding switch SW1 is not ON. i.e., is OFF, the determination unit 101 determines whether the posture change switch SW3 is ON (step S11). That is, the determination unit 101 determines whether the driver M1 has requested to change a posture of the boat body 10. The determination unit 101 performs the determination based on a signal from the posture change switch SW3.

When YES is determined in step S11, the posture change switch SW3 is ON, and changing a posture of the boat body 10 is requested, the determination unit 101 determines the operation mode of the PWC 1 to be the electric mode (step S12). The control device 100 accordingly controls the engine 5 and the electric motors 51, 61, 71 to perform the electric mode.

Specifically, similarly to step S3, when the operation mode of the PWC 1 is currently the engine mode and the engine 5 is driven, the control device 100 stops the engine 5. In contrast, when the operation mode of the PWC 1 is currently the electric mode and the engine 5 is stopped, this stop is maintained. The control device 100 also allows the electric motors 51, 61, 71 to be driven. However, the control device 100 does not necessarily cause all of the three electric motors 51, 61, 71 to be driven, and performs posture change control described below to adjust driving and stopping of the three electric motors 51, 61, 71.

When YES is determined in step S11 and the posture change switch SW3 is ON, the posture change control execution unit 106 performs the posture change control (step S13).

When the posture change control is started, the posture change control execution unit 106 first sets a target rotation angle and a target rotation direction of the boat body 10 based on operation performed on the operation lever 25 after the posture change switch SW3 is switched from OFF to ON. Specifically, the posture change control execution unit 106 sets and stores the target rotation angle that is formed by a line extending straight forward from a central axis of the operation lever 25 and the central axis of the operation lever 25 after operation from the viewpoint viewed along the central axis of the operation lever 25 at the neutral position. When the operation lever 25 is tilted clockwise, the posture change control execution unit 106 sets a clockwise direction as the target rotation direction. When the operation lever 25 is tilted counterclockwise, the posture change control execution unit 106 sets a counterclockwise direction as the target rotation direction. For example, when the operation lever 25 is tilted in a right oblique direction of 50 degrees with respect to the line, 50 degrees is stored as the target rotation angle, and the clockwise direction is stored as the target rotation direction. For example, when the operation lever 25 is tilted backward, i.e., straight backward from the neutral position, the target rotation angle is stored as 180 degrees. At this time, the clockwise direction is stored as the target rotation direction in the present embodiment.

Then, the posture change control execution unit 106 adjusts propulsion force of the second propulsion device 3, i.e., output of each of the electric motors 51, 61, 71 so that the boat body 10 rotates in the target rotation direction by the target rotation angle.

Specifically, when the posture change switch SW3 is switched from OFF to ON, the posture change control execution unit 106 stops driving the third electric motor 71 and the lateral thruster 9, and drives only the first electric motor 51 and the left longitudinal thruster 8A, and the second electric motor 61 and the right longitudinal thruster 8B. When the driving of the third electric motor 71 and the lateral thruster 9 is already stopped, the stop is maintained.

The posture change control execution unit 106 also causes output of the left longitudinal thruster 8A, i.e., output of the first electric motor 51, and output of the right longitudinal thruster 8B, i.e., output of the second electric motor 61, to be equal to each other as posture change output smaller than maximum output. The posture change output is preset and stored in the control device 100.

At this time, when the target rotation direction is the clockwise direction, the posture change control execution unit 106 drives the first electric motor 51 to rotate forward to drive the left longitudinal thruster 8A in the backward injection mode, and drives the second electric motor 61 and the right longitudinal thruster 8B in the forward injection mode. That is, the posture change control execution unit 106 drives the first electric motor 51 to rotate forward and drives the second electric motor 61 to rotate reversely. In this way, the boat body 10 can be turned in the clockwise direction, i.e., rotated clockwise while movement of the center of gravity of the boat body 10 is suppressed by combining backward propulsion force of the right longitudinal thruster 8B and forward propulsion force of the left longitudinal thruster 8A.

In contrast, when the target rotation direction is the counterclockwise direction, the posture change control execution unit 106 drives the left longitudinal thruster 8A in the forward injection mode and drives the right longitudinal thruster 8B in the backward injection mode. That is, the posture change control execution unit 106 drives the first electric motor 51 to rotate reversely and drives the second electric motor 61 to rotate forward. As a result, the posture change control execution unit 106 causes the boat body 10 to be turned in the counterclockwise direction, i.e., rotated counterclockwise while suppressing the movement of the center of gravity of the boat body 10.

In this manner, the posture change control execution unit 106 changes the posture of the boat body 10 by adjusting a magnitude of propulsion force of each of the left longitudinal thruster 8A and the right longitudinal thruster 8B.

After the posture change control is started, the posture change control execution unit 106 determines whether the boat body 10 has a rotation angle more than or equal to the target rotation angle. Specifically, the posture change control execution unit 106 calculates the rotation angle of the boat body 10 from timing at which the posture change switch SW3 is switched from OFF to ON based on a detection value of the IMU 60, and determines whether the calculated rotation angle is equal to or larger than the target rotation angle. When determining that the rotation angle of the boat body 10 is equal to or larger than the target rotation angle, the posture change control execution unit 106 stops driving the first electric motor 51, the left longitudinal thruster 8A, the second electric motor 61, and the right longitudinal thruster 8B, and forcibly returns the posture change switch SW3 from ON to OFF.

After step S11, the control device 100 returns to step S1. Step S11 and subsequent steps are performed again when the following conditions are satisfied: YES is determined in step S1 and the battery 80 has remaining capacity larger than the determination capacity: NO is determined in step S3 and the driver M1 has not fallen into the water: NO is determined in step S5 and the PWC 1 is not located within the restriction area; and NO is determined in step S8 and the fixed point holding switch SW1 is OFF. As a result, while the above conditions are satisfied, once the posture change switch SW3 is switched from OFF to ON, the operation mode of the PWC 1 is maintained in the electric mode to continue the posture change control described above until the posture change switch SW3 is switched to OFF by the driver M1, or until the posture change switch SW3 is switched to OFF as the rotation angle of the boat body 10 increases to the target rotation angle or more. As described above, in the present embodiment, the fixed point holding switch SW1 and the posture change switch SW3 cannot be turned on at the same time. Thus, when YES is determined in step S11. NO is determined in step S8. When the battery 80 has remaining capacity less than the determination capacity (NO is determined in step S1) with the posture change switch SW3 in an ON state, falling overboard of the driver M1 is detected (YES is determined in step S2), or the PWC 1 moves into the restriction area (YES is determined in step S5), the posture change switch SW3 is forcibly switched to OFF.

Returning to step S11, when NO is determined in step S11 and the posture change switch SW3 is OFF, the determination unit 101 determines whether the automatic navigation switch SW2 is ON (step S14). That is, the determination unit 101 determines whether the driver M1 requests the automatic navigation control to be performed, more specifically, whether moving the boat body 10 toward the target position is requested. The determination unit 101 performs the determination based on a signal from the automatic navigation switch SW2.

When YES is determined in step S14, the automatic navigation switch SW2 is ON, and moving the boat body 10 toward the target position is requested, the determination unit 101 determines the operation mode of the PWC 1 to be the electric mode (step S15). The control device 100 accordingly controls the engine 5 and the electric motors 51, 61, 71 to perform the electric mode.

Specifically, similarly to step S3, when the operation mode of the PWC 1 is currently the engine mode and the engine 5 is driven, the control device 100 stops the engine 5. In contrast, when the operation mode of the PWC 1 is currently the electric mode and the engine 5 is stopped, this stop is maintained. The control device 100 also allows the electric motors 51, 61, 71 to be driven. However, the control device 100 does not necessarily cause all of the three electric motors 51, 61, 71 to be driven, and performs automatic navigation control described below to adjust driving and stopping of the three electric motors 51, 61, 71.

When YES is determined in step S15 and the automatic navigation switch SW2 is ON, the automatic navigation control execution unit 105 performs the automatic navigation control (step S16).

When the automatic navigation control is started, the automatic navigation control execution unit 105 first stores the target position of the boat body 10. The target position can be input to the display 15 by the driver M1 in the present embodiment, and the automatic navigation control execution unit 105 stores the target position input to the display 15. For example, when the automatic navigation switch SW2 is switched from OFF to ON, the control device 100 causes the display 15 to display a map, and the automatic navigation control execution unit 105 stores a point on the map pressed by the driver M1 as the target position. Then, the automatic navigation control execution unit 105 adjusts propulsion force of the second propulsion device 3, i.e., output of each of the electric motors 51, 61, 71 so that the PWC 1 is navigated toward the target position. For example, the automatic navigation control execution unit 105 calculates a route for causing the PWC 1 to arrive at the target position based on the current position and the target position of the PWC 1 identified by the position identification unit 110 when the automatic navigation switch SW2 is switched from OFF to ON. Then, the automatic navigation control execution unit 105 adjusts propulsion force of each of the thrusters 8A, 8B, 9, i.e., the electric motors 51, 61, 71 to move the PWC 1 along the calculated route.

After the automatic navigation control is started, the automatic navigation control execution unit 105 determines whether the boat body 10 has reached the target position. Specifically: the automatic navigation control execution unit 105 determines that the boat body 10 has reached the target position when a separation distance between the current position of the PWC 1 identified by the position identification unit 110 and the target position becomes equal to or less than a predetermined distance preset and stored in the control device 100. Then, when determining that the boat body 10 has reached the target position, the automatic navigation control execution unit 105 stops driving each of the thrusters 8A, 8B. 9 and each of the electric motors 51, 61, 71, and forcibly returns the automatic navigation switch SW2 from ON to OFF.

After step S16, the control device 100 returns to step S1. Step S14 and subsequent steps are performed again when the following conditions are satisfied: YES is determined in step S1 and the battery 80 has remaining capacity larger than the determination capacity: NO is determined in step S3 and the driver M1 has not fallen into the water: NO is determined in step S5 and the PWC 1 is not located within the restriction area: NO is determined in step S8 and the fixed point holding switch SW1 is OFF; and NO is determined in step S11 and the posture change switch SW3 is OFF. As a result, while the above conditions are satisfied, once the automatic navigation switch SW2 is switched from OFF to ON, the operation mode of the PWC 1 is maintained in the electric mode to continue the automatic navigation control described above until the automatic navigation switch SW2 is switched to OFF by the driver M1, or until the automatic navigation switch SW2 is switched to OFF as the boat body 10 reaches the target position. As described above, in the present embodiment, the automatic navigation switch SW2, the fixed point holding switch SW1, and the posture change switch SW3 cannot be turned on at the same time. Thus, when YES is determined in step S14. NO is determined in steps S8 and S11. When the battery 80 has remaining capacity less than the determination capacity (NO is determined in step S1) with the posture change switch SW3 in an ON state, falling overboard of the driver M1 is detected (YES is determined in step S2), or the PWC 1 moves into the restriction area (YES is determined in step S5), the posture change switch SW3 is forcibly switched to OFF.

Returning to step S14, when NO is determined in step S14 and the automatic navigation switch SW2 is OFF, the determination unit 101 determines whether the electric manual navigation switch SW4 is ON (step S17). The determination unit 101 performs the determination based on a signal from the electric manual navigation switch SW4.

When YES is determined in step S17 and the electric manual navigation switch SW4 is ON, the determination unit 101 determines the operation mode of the PWC 1 to be the electric mode (step S18). The control device 100 accordingly controls the engine 5 and the electric motors 51, 61, 71 to perform the electric mode.

Specifically, similarly to step S3, when the operation mode of the PWC 1 is currently the engine mode and the engine 5 is driven, the control device 100 stops the engine 5. The control device 100 also allows the electric motors 51, 61, 71 to be driven. However, the control device 100 does not necessarily cause all of the three electric motors 51, 61, 71 to be driven, and adjusts driving and stopping of the three electric motors 51, 61, 71 in response to operation on the operation lever 25 as described below: In contrast, when the operation mode of the PWC 1 is currently the electric mode, the engine 5 is stopped, and the electric motors 51, 61, 71 are already driven, the control device 100 maintains these states.

When YES is determined in step S17 and the electric manual navigation switch SW4 is ON, the control device 100 adjusts propulsion force of the second propulsion device 3, i.e., output of each of the electric motors 51, 61, 71, in response to operation of the operation lever 25 to change a traveling direction and speed of the boat body 10 (step S19) similarly to step S7 described above. Specifically, the control device 100 changes output of each of the electric motors 51, 61, 71 of the corresponding thrusters 8A, 8B. 9 to cause a tilting direction of the operation lever 25 and operation (traveling direction) of the boat body 10 to have the relationship illustrated in FIG. 5, and speed of the boat body 10 to be changed in accordance with a tilting angle of the operation lever 25.

After step S19, the control device 100 returns to step S1. Step S17 and subsequent steps are performed again when the following conditions are satisfied: YES is determined in step S1 and the battery 80 has remaining capacity larger than the determination capacity: NO is determined in step S3 and the driver M1 has not fallen into the water: NO is determined in step S5 and the PWC 1 is not located within the restriction area: NO is determined in step S8 and the fixed point holding switch SW1 is OFF: NO is determined in step S11 and the posture change switch SW3 is OFF; and NO is determined in step S14 and the automatic navigation switch SW2 is OFF. Thus, when the electric manual navigation switch SW4 is once switched from OFF to ON while the above conditions are satisfied, the operation mode of the PWC 1 is maintained in the electric mode until the electric manual navigation switch SW4 is switched to OFF, and thus the control based on the operation of the operation lever 25 described above is continued. As described above, in the present embodiment, the electric manual navigation switch SW4, the automatic navigation switch SW2, the fixed point holding switch SW1, and the posture change switch SW3 cannot be turned on at the same time. Thus, when YES is determined in step S17. NO is determined in steps S8, S11, and S17. When the battery 80 has remaining capacity less than the determination capacity (NO is determined in step S1) with the electric manual navigation switch SW4 in an ON state, falling overboard of the driver M1 is detected (YES is determined in step S2), or the PWC 1 moves into the restriction area (YES is determined in step S5), the electric manual navigation switch SW4 is forcibly switched to OFF.

As described above, when the electric manual navigation switch SW4 is turned ON, the operation mode of the PWC 1 is determined to be the electric mode in the present embodiment. Then, the electric manual navigation switch SW4 corresponds to an "operation unit" in the present disclosure, and the operation of turning on the electric manual navigation switch SW4 corresponds to the "predetermined operation" in the present disclosure.

Returning to step S17, when NO is determined in step S17 and the electric manual navigation switch SW4 is OFF, the determination unit 101 determines the operation mode of the PWC 1 to be the engine mode (step S20). Specifically, when YES is determined in step S1 and NO is determined in steps S2, S5, S8, S11, S14, and S17, the determination unit 101 determines the operation mode of the PWC 1 to be the engine mode. That is, even when the battery capacity is equal to or more than the determination capacity, the determination unit 101 determines the operation mode of the PWC 1 to be the engine mode in a case where the driver M1 does not fall into the water (NO is determined in step S2), the PWC 1 is not located within the restriction area (NO is determined in step S5), and all of the automatic navigation switch SW2, the fixed point holding switch SW1, the posture change switch SW3, and the electric manual navigation switch SW4 are OFF. After step S17, the processing returns to step S1.

[Effects]

As described above, the PWC 1 of the present embodiment includes the engine 5 and the electric motors 51, 61, 71 as the drive sources of the respective propulsion devices, and the operation mode of the PWC 1 is switched between the engine mode in which the corresponding propulsion device is driven by the engine 5 and the electric mode in which the corresponding propulsion device is driven by the electric motors 51, 61, 71. The electric motors 51, 61, 71 each cause a driving sound that is likely to be reduced to be smaller than a driving sound of the engine 5. Thus, the PWC 1 in the operation mode set to the electric mode enables the boat body 10 to be moved while the engine 5 is stopped, and thus enables navigation with quietness secured to be achieved. Additionally, using the electric motors 51, 61, 71 enables navigation at a low speed to be likely to be achieved as compared with the engine 5. This configuration enables increasing maximum speed of the boat body 10 by setting the operation mode of the PWC 1 to the engine mode while achieving navigation of the boat body 10 at a slow speed by setting the operation mode of the PWC 1 to the electric mode. Enabling navigation at a slow speed enables a position of the boat body 10 to be accurately controlled.

In the PWC 1 of the present embodiment, a total value of the maximum outputs of the electric motors 51, 61, 71 is smaller than a maximum output of the engine 5. Thus, setting the operation mode of the PWC 1 to the electric mode enables not only enhancing quietness reliably, but also achieving navigation at a slow speed reliably.

The PWC 1 of the present embodiment is configured to set the operation mode of the PWC 1 to the electric mode when the driver M1 falls into the water and when the boat body 10 is moved to a falling overboard position of the driver M1. Thus, the boat body 10 can be navigated at a slow speed to approach the driver M1. The electric motor causes smaller vibration than the engine, and thus is less likely to generate waves. As a result, waves to be generated around the driver M1 having fallen into the water can be reduced.

The PWC 1 of the present embodiment sets the operation mode of the PWC 1 to the electric mode when the boat body 10 is located within the restriction area. Thus, the boat body 10 can be moved while suppressing noise and speed by stopping the engine 5 in the restriction area.

The PWC 1 of the present embodiment enables a position of the boat body 10 to be accurately controlled by setting the operation mode of the PWC 1 to the electric mode when the fixed point holding switch SW1 is turned on and the boat body 10 is requested to be maintained at a fixed position. Thus, displacement of the boat body 10 from the fixed position can be reduced small.

The PWC 1 of the present embodiment enables a position of the boat body 10 to be accurately controlled by setting the operation mode of the PWC 1 to the electric mode when the automatic navigation switch SW2 is turned on and the boat body 10 is requested to be moved to a target position. Thus, the boat body 10 can be brought closer to the target position.

The PWC 1 of the present embodiment enables the boat body 10 to be navigated at a slow speed by setting the operation mode of the PWC 1 to the electric mode when the posture change switch SW3 is turned on and the boat body 10 is requested to be changed in posture. Thus, the boat body 10 can be changed in posture while suppressing movement of the center of gravity of the boat body, so that operation of docking the boat body 10 is facilitated. In particular, in the PWC 1 of the present embodiment, the boat body 10 is changed in posture automatically by setting a target posture (a target rotation angle and a target rotation direction), so that the docking and the like are reliably facilitated.

The PWC 1 of the present embodiment sets the operation mode of the PWC 1 to the electric mode when the driver M1 turns on the electric manual navigation switch SW4. That is, the driver M1 can appropriately switch the operation mode of the PWC 1 between the engine mode and the electric mode, so that convenience can be improved.

In the PWC 1 of the present embodiment, the second propulsion device 3 includes the pair of left and right longitudinal thrusters 8A, 8B each having an injection axis of a water flow (the center axis of the impeller) facing the longitudinal direction and the lateral thruster 9 having an injection axis of a water flow facing the lateral direction, so that the PWC 1 can be moved in the longitudinal direction or the PWC 1 can be moved in the lateral direction (width direction) using the corresponding thrusters 8A, 8B, 9. Alternatively, propulsion force for moving the PWC 1 in an oblique direction can be generated by turning on or off the corresponding thrusters 8A, 8B. 9 or setting output of the corresponding thrusters 8A, 8B, 9, so that the PWC 1 can be turned by the propulsion force.

Additionally, the PWC 1 of the present embodiment enables an injection direction of a water flow to be changed by using the left and right longitudinal thrusters 8A, 8B and the lateral thruster 9 in the present embodiment, so that the PWC 1 can be moved with a higher degree of freedom. That is, each of the left and right longitudinal thrusters 8A, 8B can be driven in any of the backward injection mode for generating forward propulsion force and the forward injection mode for generating backward propulsion force, and the lateral thruster 9 can be driven in any of the rightward injection mode for generating leftward propulsion force and the leftward injection mode for generating rightward propulsion force. Using the thrusters 8A, 8B. 9 as described above enables the PWC 1 to be moved in any of the front, rear, left, right, and oblique directions, and thus enabling the degree of freedom of movement of the PWC 1 to be expanded.

The PWC 1 provided with not only the longitudinal thrusters 8A, 8B but also the lateral thruster 9 as in the present embodiment enables the PWC 1 to be moved directly sideways by using a water flow in the lateral direction injected from the lateral thruster 9. Moving directly sideways of the PWC 1 as described above cannot be achieved by the first propulsion device 2 using the jet pump 6, and thus is particularly convenient to dock the PWC 1.

[Modification]

Although the embodiment above describes the determination unit 101 that stores an area in which a speed limit of a navigation object, the area being set as the restriction area, an area determined as the restriction area by the determination unit 101 is not limited the area being set above. For example, an area with a noise level determined to be equal to or less than a predetermined level or an area with the amount of emission of exhaust gas determined to be equal to or less than a predetermined amount may be stored in the determination unit 101 as the restriction area. When the PWC 1 is located in these areas, YES may be determined in step S5.

Although the embodiment above describes a relative posture with respect to a current posture, the relative posture being set as the target posture (the target rotation angle and the target rotation direction) when the posture change control is performed, an absolute posture of the boat body 10 may be set as the target posture. For example, an absolute posture such as a northern posture may be set as the target posture of the boat body 10.

Although the embodiment above describes determination of whether the driver M1 falls into the water, the determination being performed using the tether sensor SN1, specific means for determining (detecting) falling overboard of the driver M1 is not limited to the tether sensor SN1.

Although the embodiment above describes the position identification unit 110 that identifies a current position of the PWC 1 when the tether sensor SN1 detects release of the connection between the tether 90 and the start and stop switch 22, the current position being identified as the falling overboard position, a specific configuration for identifying the falling overboard position of the driver M1 is not limited the configuration described above. For example, the falling overboard position of the driver M1 may be specified based on a signal from a transmitter or the like worn by the driver M1.

Although the embodiment above describes the target position that is set by input operation to the display 15, a specific procedure for setting the target position is not limited to the input operation.

Although the embodiment above describes the switches SW1, SW2, SW3, SW4 that are provided in the display 15 of a touch panel type, these switches SW1, SW2, SW3, SW4 may be provided in other parts.

Although the embodiment above describes the control device 100 (the determination unit 101) that determines that the boat body 10 is requested to be maintained at the fixed position when the fixed point holding switch SW1 is turned on, a specific procedure of determination of whether the boat body 10 is requested to be maintained at the fixed position is not limited to that of the determination of the control device 100. Specifically, regardless of operation of the driver M1 on the switch or the like mounted on the boat body 10, the control device 100 may determine that the boat body 10 is automatically requested to be maintained at the fixed position. For example, the control device 100 may be provided with a function of detecting that the driver M1 starts fishing, and may determine that the boat body 10 is requested to be maintained at a fixed position when the start of the fishing is detected.

Although the embodiment above describes the control device 100 (the determination unit 101) that determines that the boat body 10 is requested to be moved toward a target position when the automatic navigation switch SW2 is turned on, a specific procedure of determination of whether the boat body 10 is requested to be moved toward the target position is not limited to that of the determination of the control device 100.

Although the embodiment above describes the control device 100 (determination unit 101) that determines that the boat body 10 is requested to be changed in posture when the posture change switch SW3 is turned on, a specific procedure of determination of whether the boat body 10 is requested to be changed in posture is not limited to that of the determination of the control device 100.

Although the embodiment above describes propulsion force of the second propulsion device 3, i.e., output of each of the electric motors 51, 61, 71 that can be adjusted in response to operation of the operation lever 25 when the electric manual navigation switch SW4 is turned on, operation of enabling the output to be adjusted is not limited to operation of turning on the electric manual navigation switch SW4.

Although the second propulsion device 3 is controlled to turn the PWC 1 clockwise (counterclockwise) when the operation lever 25 which is a joystick is tilted obliquely rightward (obliquely leftward) in the embodiment, the second propulsion device 3 may be controlled such that the PWC 1 linearly travels obliquely rightward (obliquely leftward) during a similar operation. Additionally, a mode selector switch may be separately provided to appropriately select a mode of turning the PWC 1 or a mode of linearly oblique traveling of the PWC 1.

Although the embodiment above describes the joystick-type operation lever 25 as means for operating the second propulsion device 3, the means for operating the second propulsion device 3 is not limited to the operation lever 25. For example, instead of the operation lever 25, a push button, a touch panel, or the like may be provided as the means for operating the second propulsion device 3.

Although the embodiment above describes the target rotation angle and the target rotation direction of the boat body 10 that are set by operating the operation lever 25 to change a posture of the boat body 10, a specific procedure for setting the target rotation angle and the target rotation direction is not limited to the above procedure.

The embodiment above describes the first propulsion device 2 (engine 5) that is started when the predetermined operation is performed on the start and stop switch 22. That is, although the embodiment above describes PWC 1 in which the operation mode of the PWC 1 at start of navigation is determined to be the engine mode when the predetermined operation is performed on the start and stop switch 22, the operation mode of the PWC 1 at the start of navigation may not be determined to be any of the engine mode and the electric mode depending on the operation on the start and stop switch 22.

Although the embodiment above describes the three electric motors 51, 61, 71 that are equal in maximum output, the electric motors 51, 61, 71 may be configured to allow any one of the three electric motors to be different in maximum output from the other two electric motors, or allow the three electric motors to be different in maximum output from one another.

Although the embodiment above describes the electric motors 51, 61, 71 that have maximum output as a whole, i.e., a total value of maximum outputs of the respective electric motors 51, 61, 71, being smaller than maximum output of the engine, the total value of the maximum outputs of the respective electric motors 51, 61, 71 may be equal to or smaller than the maximum output of the engine.

Although the embodiment above describes the PWC 1 in which the operation mode is determined to be the engine mode when the battery 80 has remaining capacity less than the determination capacity regardless of whether the operation mode of the PWC 1 is currently the engine mode or the electric mode, the PWC 1 may be configured to maintain the electric mode even with the battery 80 having remaining capacity reduced to less than the determination capacity when the operation mode of the PWC 1 is currently the electric mode. That is, the PWC 1 may be configured to prohibit only switching of the operation mode of the PWC 1 from the engine mode to the electric mode when the battery 80 has remaining capacity less than the determination capacity.

Although the embodiment above describes the falling overboard control that is performed when the driver M1 falls into the water even when the fixed point holding switch SW1, the automatic navigation switch SW2, the posture change switch SW3, and the electric manual navigation switch SW4 are ON, start of the falling overboard control may be prohibited when the switches SW1 to SW4 are ON. Similarly, although the embodiment above describes the falling overboard control that is performed when the driver M1 falls into the water even when the boat body 10 is located within the restriction area, the falling overboard control may be prohibited from starting when the boat body 10 is located within the restriction area. Although the embodiment above describes the fixed point holding control, the automatic navigation control, and the posture change control that are stopped when the boat body 10 moves into the restriction area even when the fixed point holding switch SW1, the automatic navigation switch SW2, and the posture change switch SW3 are ON, when the switches SW1 to SW3 are ON, each control described above may be maintained even when the boat body 10 moves into the restriction area.

Although the entrances of the water passages 41, 42, 43 of the corresponding thrusters 8A, 8B. 9 are each formed at a position displaced in the longitudinal direction and the lateral direction from the center of gravity G of the PWC 1 in the embodiment above, the entrances of at least some of the water passages may be each formed at a position displaced only in one of the longitudinal direction and the lateral direction.

Although the embodiment above describes the second propulsion device 3 that includes the three thrusters 8A, 8B, 9, any one or two thrusters may be eliminated. Alternatively, another thruster that generates propulsion force in a direction inclined with respect to the longitudinal direction or the lateral direction may be prepared. Although the two longitudinal thrusters 8A. 8B are respectively attached to the left and right side parts of the boat body 10 in the embodiment above, the number of longitudinal thrusters may be one, for example.

Although the embodiment above describes the thrusters 8A, 8B. 9 that are respectively driven by the electric motors 51, 61, 71 different from each other, some or all of the three thrusters 8A, 8B. 9 may be driven by a common electric motor. For example, the power source of the left longitudinal thruster 8A and the power source of the right longitudinal thruster 8B may be configured by a common electric motor, and the common electric motor and each of the propeller shafts of the left and right longitudinal thrusters 8A, 8B may be coupled via a predetermined power transmission mechanism.

Although the electric motor 51 and the propeller shaft 52 in the left longitudinal thruster 8A are directly coupled in the embodiment above, the electric motor 51 and the propeller shaft 52 may be coupled via a power transmission mechanism. In this case, a direction of an output shaft of the electric motor 51 may be different from an axial direction of the propeller shaft 52. The same applies to the right longitudinal thruster 8B.

Although the reverse bucket 7 is provided in the outlet part of the jet pump 6 to allow the PWC 1 to be moved backward using the first propulsion device 2 of an engine type in the embodiment above, the reverse bucket 7 is not essential when the PWC 1 can be moved backward using the second propulsion device 3 of an electric type. When the reverse bucket 7 is not provided, the PWC 1 is moved backward exclusively using the second propulsion device 3.

Although the impellers 53, 63, 73 are each used as a rotating element of the second propulsion device 3 that generates a water flow in the embodiment above, the rotating element of the second propulsion device 3 is only required to generate a water flow by rotation, and thus may be a screw or a propeller, for example. The second propulsion device 3 also may be a propulsion device of a type in which a fluid such as air or water sucked from the outside is discharged using a pump.

To use the second propulsion device of a type in which propulsion force is generated by injection of a water flow; the second propulsion device may include a water passage including an inlet and an outlet of the water flow and a power source that generates power for generating the water flow flowing through the water passage, and a specific form may be variously changed. For example, the water passage may be a branched passage in which the number of inlets is smaller than the number of outlets. In this case, the water passage may be provided in its branched part with a valve for switching a flow of the water flow to change a moving direction of the PWC 1. The number of power sources such as the electric motor may be reduced to be smaller than the number of outlets of the water passage.

Although the embodiment above describes the two propulsion devices of the first propulsion device 2 driven by the engine 5 and the second propulsion device 3 driven by the electric motors 51, 61, 71, the two propulsion devices being mounted on the boat body 10, a common propulsion device may be configured to have a drive source to be switched between an engine and an electric motor. This configuration also enables obtaining an effect of being able to obtain high propulsion force using the engine mode and an effect of being able to obtain high quietness and slow navigation using the electric mode by switching the operation mode of the PWC 1 between the engine mode in which the propulsion device is driven by the engine and the electric mode in which the propulsion device is driven by the electric motor.

Although the jet propulsion boat (PWC 1) of a riding type including the seat 14 is described as an example of the jet propulsion boat according to the present disclosure in the first embodiment, the jet propulsion boat may be of a stand-up type on which a driver rides in an upright position.

SUMMARY

The embodiments and modifications thereof include the following disclosure.

A jet propulsion boat according to an aspect of the present disclosure includes a boat body, a propulsion device that imparts propulsion force to the boat body to propel the boat body, an engine and an electric motor that drive the propulsion device, and a control device that determines which of an engine mode and an electric mode is to be used as an operation mode of driving the propulsion device in accordance with a condition, the engine mode configured to drive the propulsion device with the engine and the electric mode configured to drive the propulsion device with the electric motor while stopping the engine, and controls the engine and the electric motor to drive the propulsion device in the determined operation mode.

The present disclosure allows the driving source of the propulsion device to switched between the engine and the electric motor depending on conditions. Thus, the boat body can be appropriately navigated depending on the situation. In particular, when the propulsion device is driven by the electric motor, the boat body can be moved while the engine is stopped, and thus enabling navigation with quietness secured to be achieved. The propulsion device driven by the electric motor enables propulsion force of the propulsion device to be reduced. As a result, the engine mode enables increasing maximum speed while the electric mode achieves navigation at a slow speed. Achieving the navigation at a slow speed enables a position of the boat body to be accurately controlled.

The electric motor preferably has maximum output smaller than maximum output of the engine.

This aspect enables enhancing quietness during navigation in the electric mode. This aspect also enables achieving navigation at slow speed of the boat body and improvement of control accuracy of a position of the boat body more reliably in the electric mode. Additionally, while effects as described above are obtained, the engine having large maximum output enables increasing maximum speed of the boat body.

The propulsion device preferably includes a first propulsion device that is driven by the engine to impart propulsion force to the boat body, and a second propulsion device that is driven by the electric motor to impart propulsion force to the boat body, the propulsion force being different from the propulsion force imparted to the boat body by the first propulsion device.

This aspect does not require the engine and the electric motor to be coupled to a common propulsion device. This aspect also does not require a drive source to be switched between the engine and the electric motor to couple the drive source to the propulsion device. Thus, this aspect enables simplifying structure.

The second propulsion device is preferably capable of imparting propulsion force to the boat body; the propulsion force being different in direction from the propulsion force of the first propulsion device.

This aspect enables the second propulsion device to achieve movement of the boat body which cannot be achieved by the first propulsion device.

The second propulsion device is preferably capable of imparting the propulsion force in each of a plurality of directions different from each other to the boat body.

This aspect enables the boat body to be easily moved in the plurality of directions when the second propulsion device imparts propulsion force to the boat body.

The second propulsion device preferably includes a plurality of thrusters that are each capable of imparting propulsion force different in direction to the boat body, and the control device adjusts a traveling direction of the boat body by adjusting a magnitude of propulsion force of each of the plurality of thrusters when the propulsion device is driven in the electric mode.

This aspect enables the boat body to be easily moved in the plurality of directions when the second propulsion device imparts propulsion force to the boat body. Additionally: a traveling direction of the boat body can be adjusted by adjusting a magnitude of propulsion force of each of the plurality of thrusters, and thus facilitating adjustment of the traveling direction of the boat body.

The second propulsion device preferably includes a plurality of thrusters that are each capable of imparting propulsion force different in direction to the boat body, and the control device adjusts a posture of the boat body by adjusting a magnitude of propulsion force of each of the plurality of thrusters when the propulsion device is driven in the electric mode.

This aspect enables the boat body to be easily moved in the plurality of directions when the second propulsion device imparts propulsion force to the boat body. Additionally, a posture of the boat body can be adjusted by adjusting a magnitude of propulsion force of each of the plurality of thrusters, and thus facilitating adjustment of the posture of the boat body.

The jet propulsion boat preferably includes a falling overboard detector configured to detect that a driver of the jet propulsion boat has fallen into the water, in which the control device determines the operation mode to be the electric mode when the falling overboard detector detects that the driver has fallen into the water.

This aspect enables reducing generation of waves rising around the driver having fallen into the water because the drive source of the propulsion device is switched to the electric motor having smaller vibration than the engine when the driver falls into the water.

The jet propulsion boat preferably includes a falling overboard position detector configured to detect a falling overboard position of the driver, in which when the falling overboard detector detects that the driver has fallen into the water, the control device causes the boat body to be navigated toward the falling overboard position of the driver detected by the falling overboard position detector in a state where the operation mode is set to the electric mode.

This aspect enables a position of the boat body to be controlled with high accuracy when the driver falls into the water, and thus enables the boat body to be brought closer to a falling overboard position.

The control device preferably determines the operation mode to be the electric mode when the boat body is requested to be maintained at a fixed position.

This aspect enables position control with high accuracy of the boat body when the boat body is requested to be maintained at a fixed position, and thus enables reducing displacement of the boat body from the fixed position.

The control device preferably determines the operation mode to be the electric mode when the boat body is requested to be moved toward a target position.

This aspect enables position control with high accuracy of the boat body when the boat body is requested to be moved toward the target position, and thus enables the boat body to be brought closer to the target position.

The control device preferably determines the operation mode to be the electric mode when the boat body is requested to be changed in posture.

This aspect enables the boat body to be changed in posture while navigating the boat body at a slow speed, and thus enables changing the posture of the boat body while suppressing movement of the center of gravity of the boat body.

The control device preferably includes an area determination unit that determines whether the boat body is located within a predetermined restriction area, and when the area determination unit determines that the boat body is located within the predetermined restriction area, the control device determines the operation mode to be the electric mode.

This aspect enables the boat body to be moved while stopping the engine in the restriction area.

The jet propulsion boat preferably includes an operation unit operated by a driver of the jet propulsion boat, in which the control device determines the operation mode to be the electric mode when predetermined operation is performed on the operation unit.

This aspect enables the driver to appropriately switch the operation mode from the engine mode to the electric mode, and thus improves convenience.

The jet propulsion boat preferably includes a battery mounted on the boat body to supply power to the electric motor, and a remaining battery capacity detector configured to detect remaining capacity of the battery, in which the control device prohibits switching from the engine mode to the electric mode when the remaining capacity of the battery detected by the remaining battery capacity detector is equal to or less than predetermined determination capacity.

This aspect prevents the electric motor from being driven with small remaining capacity of the battery, and thus enables preventing the remaining capacity of the battery from being excessively lowered.

The jet propulsion boat preferably includes a display unit mounted on the boat body to display the operation mode that is switched from the engine mode to the electric mode.

This aspect enables the driver to recognize the current operation mode.

The invention claimed is:

1. A jet propulsion boat comprising:

a boat body;

a propulsion device that imparts propulsion force to the boat body to propel the boat body;

an engine and an electric motor that drive the propulsion device;

control circuitry configured to determine which of an engine mode and an electric mode is to be used as an operation mode of driving the propulsion device in accordance with a condition, the engine mode configured to drive the propulsion device with the engine and the electric mode configured to drive the propulsion device with the electric motor while stopping the engine, and controls the engine and the electric motor to drive the propulsion device in the determined operation mode; and a display mounted on the boat body to display the operation mode that is switched from the engine mode to the electric mode.

2. The jet propulsion boat according to claim 1, wherein:

the electric motor has maximum output smaller than maximum output of the engine.

3. The jet propulsion boat according to claim 1, wherein the propulsion device includes:

a first propulsion device that is driven by the engine to impart propulsion force to the boat body, and a second propulsion device that is driven by the electric motor to impart propulsion force to the boat body, the propulsion force of the second propulsion device being different from the propulsion force imparted to the boat body by the first propulsion device.

4. The jet propulsion boat according to claim 3, wherein:

the second propulsion device is to impart propulsion force to the boat body, the propulsion force being different in direction from the propulsion force of the first propulsion device.

5. The jet propulsion boat according to claim 3, wherein:

the second propulsion device is to impart the propulsion force in each of a plurality of directions different from each other to the boat body.

6. The jet propulsion boat according to claim 5, wherein:

the second propulsion device includes a plurality of thrusters that are each capable of imparting propulsion force different in direction to the boat body, and the control circuitry adjusts a traveling direction of the boat body by adjusting a magnitude of propulsion force of each of the plurality of thrusters when the propulsion device is driven in the electric mode.

7. The jet propulsion boat according to claim 5, wherein:

the second propulsion device includes a plurality of thrusters that are each capable of imparting propulsion force different in direction to the boat body, and the control circuitry adjusts a posture of the boat body by adjusting a magnitude of propulsion force of each of the plurality of thrusters when the propulsion device is driven in the electric mode.

8. The jet propulsion boat according to claim 1, further comprising:

a falling overboard detector configured to detect that a driver of the jet propulsion boat has fallen into the water, wherein the control circuitry determines the operation mode to be the electric mode when the falling overboard detector detects that the driver has fallen into the water.

9. The jet propulsion boat according to claim 8, further comprising:

a falling overboard position detector configured to detect a falling overboard position of the driver, wherein when the falling overboard detector detects that the driver has fallen into the water, the control circuitry causes the boat body to navigate toward the falling overboard position of the driver detected by the falling overboard position detector in a state where the operation mode is set to the electric mode.

10. The jet propulsion boat according to claim 1, wherein:

the control circuitry determines the operation mode to be the electric mode when the boat body is requested to be maintained at a fixed position.

11. The jet propulsion boat according to claim 1, wherein:

the control circuitry determines the operation mode to be the electric mode when the boat body is requested to be moved toward a target position.

12. The jet propulsion boat according to claim 1, wherein:

the control circuitry determines the operation mode to be the electric mode when the boat body is requested to be changed in posture.

13. The jet propulsion boat according to claim 1, wherein:

the control circuitry includes area determination circuitry configured to detect whether the boat body is located within a predetermined restriction area, and when the area determination circuitry determines that the boat body is located within the predetermined restriction area, the control circuitry determines the operation mode to be the electric mode.

14. The jet propulsion boat according to claim 1, further comprising:

an operation interface to interface with a driver of the jet propulsion boat, wherein the control circuitry determines the operation mode to be the electric mode when a predetermined operation is performed on the operation interface.

15. The jet propulsion boat according to claim 1, further comprising:

a battery mounted on the boat body to supply power to the electric motor; and a remaining battery capacity detector configured to detect remaining capacity of the battery, wherein the control circuitry prohibits switching from the engine mode to the electric mode when the remaining capacity of the battery detected by the remaining battery capacity detector is equal to or less than predetermined determination capacity.

16. A jet propulsion boat comprising:

a boat body;

a propulsion device that imparts propulsion force to the boat body to propel the boat body;

an engine and an electric motor that drive the propulsion device;

control circuitry configured to determine which of an engine mode and an electric mode is to be used as an operation mode of driving the propulsion device in accordance with a condition, the engine mode configured to drive the propulsion device with the engine and the electric mode configured to drive the propulsion device with the electric motor while stopping the engine, and controls the engine and the electric motor to drive the propulsion device in the determined operation mode; and a falling overboard detector configured to detect that a driver of the jet propulsion boat has fallen into the water, wherein the control circuitry determines the operation mode to be the electric mode when the falling overboard detector detects that the driver has fallen into the water.

17. A jet propulsion boat comprising:

a boat body;

a propulsion device that imparts propulsion force to the boat body to propel the boat body;

an engine and an electric motor that drive the propulsion device; and control circuitry configured to determine which of an engine mode and an electric mode is to be used as an operation mode of driving the propulsion device in accordance with a condition, the engine mode configured to drive the propulsion device with the engine and the electric mode configured to drive the propulsion device with the electric motor while stopping the engine, and controls the engine and the electric motor to drive the propulsion device in the determined operation mode, wherein:

the control circuitry includes area determination circuitry configured to detect whether the boat body is located within a predetermined restriction area, and when the area determination circuitry determines that the boat body is located within the predetermined restriction area, the control circuitry determines the operation mode to be the electric mode.

* * * * *